US008336671B2

(12) United States Patent
Kondo et al.

(10) Patent No.: US 8,336,671 B2
(45) Date of Patent: Dec. 25, 2012

(54) SOUNDPROOFING COVER AND METHOD OF MANUFACTURING SAME

(75) Inventors: Hiroyuki Kondo, Gifu (JP); Yukio Hatanaka, Inuyama (JP)

(73) Assignees: Tokai Rubber Industries, Ltd., Komaki-shi, Aichi-ken (JP); Tokai Chemical Industries, Ltd., Kani County, Gifu-Pre (JP)

( * ) Notice: Subject to any disclaimer, the term of this patent is extended or adjusted under 35 U.S.C. 154(b) by 0 days.

(21) Appl. No.: 13/420,659

(22) Filed: Mar. 15, 2012

(65) Prior Publication Data

US 2012/0168246 A1 Jul. 5, 2012

Related U.S. Application Data

(63) Continuation of application No. PCT/JP2010/055690, filed on Mar. 30, 2010.

(30) Foreign Application Priority Data

Oct. 27, 2009 (JP) ..... 2009-246232

(51) Int. Cl.
*G10K 11/168* (2006.01)
*E04B 1/82* (2006.01)

(52) U.S. Cl. ..... 181/205; 181/290

(58) Field of Classification Search ..... 181/198, 181/200, 204, 205, 284, 290
See application file for complete search history.

(56) References Cited

U.S. PATENT DOCUMENTS

| | | | | |
|---|---|---|---|---|
| 4,522,165 | A * | 6/1985 | Ogawa | 123/195 C |
| 4,971,850 | A * | 11/1990 | Kuan-Hong | 428/137 |
| 5,631,451 | A * | 5/1997 | Torisaka et al. | 181/207 |
| 6,659,221 | B2 * | 12/2003 | Kuroda et al. | 181/214 |
| 7,395,799 | B2 * | 7/2008 | Liang et al. | 123/195 C |

FOREIGN PATENT DOCUMENTS

| | | | |
|---|---|---|---|
| JP | 01-061433 | U | 4/1989 |
| JP | 07-081434 | A | 3/1995 |
| JP | 2000-027125 | A | 1/2000 |
| JP | 2003-050585 | A | 2/2003 |
| JP | 2004-169394 | A | 6/2004 |
| JP | 2005-180511 | A | 7/2005 |

OTHER PUBLICATIONS

International Search Report of PCT/JP2010/055690, dated Jun. 22, 2010.

* cited by examiner

*Primary Examiner* — Jeremy Luks
(74) *Attorney, Agent, or Firm* — Westerman, Hattori, Daniels & Adrian, LLP

(57) ABSTRACT

A soundproofing cover that has a sufficiently high soundproofing performance and that allows another member to be reliably attached to the soundproofing cover with a screw-fastening structure is provided. The soundproofing cover includes a cover body, a sound absorbing layer made of a urethane foam and formed integrally with the back surface of the cover body, and a nut member having a threaded hole that opens at both sides of the nut member in an axial direction. The nut member is embedded in the cover body in a manner such that an opening of the threaded hole in the nut member at a first end in the axial direction opens at a front surface of the cover body and an opening of the threaded hole at a second end in the axial direction is blocked by a blocking portion that is formed integrally with the cover body.

10 Claims, 17 Drawing Sheets

SOUNDPROOFING COVER AND METHOD OF MANUFACTURING SAME

BACKGROUND OF THE INVENTION

1. Field of the Invention

The present invention relates to soundproofing covers and methods of manufacturing the soundproofing covers. More particularly, the present invention relates to an improvement of a soundproofing cover including a cover body and a sound absorbing layer made of a urethane foam and formed integrally with a back surface of the cover body, and a method of advantageously manufacturing the soundproofing cover.

2. Description of the Related Art

Soundproofing covers have been attached to various types of noise sources to prevent leakage of noise to the outside. For example, a soundproofing cover may be attached to a cylinder head cover of a vehicle engine to prevent leakage of noise generated in the engine.

Soundproofing covers having various structures are known. An example of such a soundproofing cover includes a cover body formed of a hard resin-molded article and a sound absorbing layer made of a urethane foam and fixed to a back surface of the cover body (see, for example, Japanese Unexamined Patent Application Publication No. 2003-50585). The soundproofing cover including the sound absorbing layer is preferably manufactured by the following method. That is, first, a cover body that has been separately formed is placed in a mold cavity of a mold, and a part of the mold cavity at the back side of the cover body is filled with a urethane resin composition. Then, the urethane resin composition is foamed, so that the sound absorbing layer made of the urethane foam is formed integrally with the back surface of the cover body. In this case, the design freedom for the shape of the sound absorbing layer can be advantageously increased.

In general, various components, members, etc. to be fixed to the vehicle engine are arranged around the soundproofing cover or the like that is attached to the cylinder head cover of the engine. These components and members are generally attached to the cylinder head cover with brackets or the like. More specifically, many known cylinder head covers have cylindrical boss portions that are formed integrally therewith. The boss portions are arranged so as to extend through holes formed in the soundproofing cover and project upward from the soundproofing cover. The brackets to which the components and members arranged above the soundproofing cover are fixed are attached to the cylinder head cover by screwing bolts into the boss portions.

However, because the soundproofing cover has through holes for allowing the boss portions to extend therethrough, noise leaks through the gaps between the inner peripheral surfaces of the through holes and the outer peripheral surfaces of the boss portions. Therefore, the soundproofing cover with the through holes according to the related art has a problem that the soundproofing performance is reduced owing to the noise leakage through the through holes.

The noise leakage through the through holes in the soundproofing cover may be prevented by eliminating the through holes by embedding nut members used to fasten the brackets or the like with screws or bolts in the cover body of the soundproofing cover. The nut members are embedded in a manner such that bearing surfaces thereof are exposed at the front surface of the cover body, that is, such that threaded holes open in the front surface of the cover body.

However, when the soundproofing cover is manufactured by the above-described preferred method in which the sound absorbing layer made of the urethane foam is formed integrally with the back surface of the cover body by foaming the urethane resin composition in the mold in which the cover body is placed, embedding the nut members in the soundproofing cover may cause the following problems.

That is, for economic reasons, nut members having threaded holes that are open at both sides of the nut members in the axial direction are generally used as the nut members to be embedded in the cover body of the soundproofing cover. Therefore, when the cover body in which the nut members are embedded is placed in the mold cavity and the urethane resin composition is foamed, there is a risk that the urethane resin composition that flows in the mold cavity will enter the threaded holes in the nut members through the openings at the side opposite to the bearing surfaces. If this happens, the urethane resin composition solidifies in the threaded holes and it becomes difficult to fasten the screws, bolts, or the like to the nut members, owing to the solidified urethane foam.

SUMMARY OF THE INVENTION

The present invention has been made in view of the above situation. An object of the present invention is to provide a soundproofing cover in which a sound absorbing layer made of a urethane foam is formed integrally with a back surface of a cover body by foaming a urethane resin composition in a mold in which the cover body is placed, the soundproofing cover having an improved structure that provides sufficiently high soundproofing performance and that allows another member to be reliably attached to the cover body with a screw-fastening structure. Another object of the present invention is to provide a method for advantageously manufacturing the soundproofing cover having the improved structure.

To achieve the above-described objects or other objects recognized from the description of the entire specification and drawings, the present invention may be carried out in accordance with various embodiments described below. The embodiments described below may be applied in an arbitrary combination. It is to be understood that the embodiments and technical features of the present invention are not limited to those described below, and should be recognized from the idea of the invention disclosed in the description of the entire specification and drawings.

To achieve the object regarding the soundproofing cover, according to the present invention, a soundproofing cover includes a cover body, a sound absorbing layer, and a nut member. The cover body is formed of a hard resin-molded article. The sound absorbing layer is fixed to a back surface of the cover body and made of a urethane foam that is formed integrally with the back surface of the cover body by foaming a urethane resin composition in a mold in which the cover body is placed. The nut member has a threaded hole that opens at both sides of the nut member in an axial direction. The nut member is embedded in the cover body in a manner such that a bearing surface at a first end in the axial direction is exposed at a front surface of the cover body and an opening of the threaded hole at the first end in the axial direction opens in the front surface of the cover body. An opening of the threaded hole in the nut member at a second end in the axial direction is blocked by a blocking portion that is formed integrally with the cover body.

The overall shape of the nut member embedded in the cover body is not particularly limited. An advantageous method for embedding the nut member into the cover body is to perform insert molding using the nut member as an object to be inserted. In such a case, the cover body can be formed and the nut member can be embedded in the cover body at the same time. Alternatively, the cover body may be molded by using a thermoplastic resin, and then be partially heated and plasticized so that the nut member can be pushed into the plasticized portion of the cover body. Alternatively, the nut member may be heated while being pressed against the cover body made of a thermoplastic resin so that the cover body is partially plasticized and the nut member can be embedded into the plasticized portion of the cover body. Another applicable method for embedding the nut member into the cover body is to form a recess that can receive the nut member in the cover body, place the nut member in the recess, and fix the nut member in that state.

In a preferred embodiment of the soundproofing cover according to the present invention, a portion of the nut member including the bearing surface at the first end in the axial direction projects from the front surface of the cover body.

In another preferred embodiment of the soundproofing cover according to the present invention, a boss portion having a height greater than a height of a portion of the nut member that is embedded in the cover body is formed integrally with the front surface of the cover body so as to project therefrom. The nut member is embedded in the boss portion in a manner such that the bearing surface is exposed at a projecting end surface of the boss portion, and the blocking portion is formed of a base end portion of the boss portion.

In another preferred embodiment of the soundproofing cover according to the present invention, a loop-shaped projection is formed integrally with the front surface of the cover body in an area around the bearing surface of the nut member so as to extend in a circumferential direction of the bearing surface of the nut member.

The overall shape of the loop-shaped projection formed on the front surface of the cover body is not limited as long as the loop-shaped projection surrounds the bearing surface of the nut member. The number of nut members embedded in the cover body is not limited. When a plurality of nut members are embedded in the cover body, a plurality of loop-shaped projections may be formed so as to individually surround the bearing surfaces of the respective nut members. Alternatively, a single loop-shaped projection may be formed so as to surround the bearing surfaces of all of the nut members. In addition, when the loop-shaped projection is formed on the front surface of the cover body, the height of the bearing surface of the nut member that is exposed at the front surface of the cover body is preferably greater than the height of the projecting end portion of the loop-shaped projection.

In another preferred embodiment of the soundproofing cover according to the present invention, the nut member is made of a material that is harder than the cover body and that expands radially while contracting in the axial direction in response to an axial force applied by a fastening member when the fastening member is fastened to the nut member. The nut member has a biting projection on an outer peripheral surface thereof, the biting projection biting into an inner peripheral surface of a hole in the cover body in which the nut member is embedded when the nut member expands radially in response to the axial force applied by the fastening member.

Also in this case, preferably, the height of the bearing surface of the nut member that is exposed at the front surface of the cover body is preferably greater than the height of the projecting end portion of the loop-shaped projection. The difference in height between the bearing surface of the nut member and the projecting end portion of the loop-shaped projection is preferably greater than an amount by which the nut member contracts in response to the axial force applied by the bolt member.

In the soundproofing cover according to the present invention, when the biting projection is formed on the outer peripheral surface of the nut member, the biting projection preferably includes a first helical biting projection and a second helical biting projection, the first helical biting projection being provided on the outer peripheral surface of the nut member in an area near the first end in the axial direction and extending helically along a circumferential direction of the nut member, and the second helical biting projection being provided on the outer peripheral surface of the nut member in an area near the second end in the axial direction and extending helically in a direction opposite to a direction in which the first helical biting projection extends along the circumferential direction of the nut member.

To achieve the object regarding the method of manufacturing the soundproofing cover, according to the present invention, a method for manufacturing the above-described soundproofing cover includes (a) preparing a first mold having a first mold cavity having a shape corresponding to a shape of the cover body, a dummy bolt that is capable of being fastened to the nut member and that is independent of the first mold, and attracting means that attracts the dummy bolt so that the dummy bolt is retained in the first mold, (b) forming the cover body in the first mold cavity in a manner such that the nut member is embedded in the cover body and the blocking portion is formed integrally with the cover body, the forming of the cover body includes fastening the dummy bolt to the nut member, causing the attracting means to attract the dummy bolt so that the dummy bolt is retained in the first mold in a manner such that the entire body of the nut member or a portion of the nut member other than a portion including the bearing surface at the first end in the axial direction projects into the first mold cavity from a first cavity surface that defines the first mold cavity, injecting a molten resin into the first mold cavity to fill the first mold cavity, and solidifying the molten resin, (c) removing the dummy bolt from the nut member embedded in the cover body after removing the cover body and the dummy bolt together from the first mold by opening the first mold, in which the cover body is formed in the first mold cavity, while releasing the dummy bolt from the state in which the dummy bolt is retained in the first mold by being attracted to the attracting means, and (d) forming the sound absorbing layer made of the urethane foam integrally with the back surface of the cover body by using a second mold having a second mold cavity having a shape corresponding to a shape of the sound absorbing layer, the forming of the sound absorbing layer includes placing the cover body in the second mold cavity, injecting the urethane resin composition into a space at the back side of the cover body in the second mold cavity, and foaming the urethane resin composition.

In a preferred embodiment of the method of manufacturing the soundproofing cover according to the present invention, the dummy bolt is fastened to the nut member by being screwed into the nut member in a manner such that an end face of the nut member at a side opposite to the bearing surface at the first end in the axial direction and an end face of a leg portion of the bolt are flush with each other. In the state in which the dummy bolt fastened to the nut member is retained in the first mold, a blocking-portion-forming cavity section for forming the blocking portion is provided in the first mold cavity in a space adjacent to the end face of the leg portion of the dummy bolt.

The state in which the "end face of the nut member at the side opposite to the bearing surface and the end face of the leg portion of the dummy bolt are flush with each other" includes (A) the state in which the end face of the nut member and the end face of the leg portion of the dummy bolt are completely flush with each other; and (B) the state in which the end of the leg portion of the dummy bolt is slightly recessed from the opening of the threaded hole in the nut member or slightly projects from the opening of the threaded hole in the nut member so that a small step is formed between the end face of the leg portion of the dummy bolt and the end face of the nut member, but it can be assumed that the end face of the leg portion of the dummy bolt and the end face of the nut member are substantially flush with each other.

In another preferred embodiment of the method of manufacturing the soundproofing cover according to the present invention, a recess is formed in the first cavity surface in an area in which the entire body of the nut member or the portion of the nut member other than the portion including the bearing surface at the first end in the axial direction projects into the first mold cavity, the recess having a depth that is greater than a projection height to which the nut member projects into the first mold cavity. The entire body of the nut member to which the dummy bolt is fastened or the portion of the nut member other than the portion at the first end in the axial direction projects into the recess from a bottom surface of the recess, and a blocking-portion-forming cavity section for forming the blocking portion is provided in the recess at a position near an opening of the recess.

In another preferred embodiment of the method of manufacturing the soundproofing cover according to the present invention, in the state in which the nut member is placed in the first mold cavity, a loop-shaped groove is formed in the first cavity surface in an area around a projecting portion of the nut member that projects into the first mold cavity, the loop-shaped groove extending in a circumferential direction of the projecting portion of the nut member. When the molten resin is injected into the first mold cavity and solidified, the cover body is formed in the first mold cavity in a manner such that the nut member is embedded in the cover body and a loop-shaped projection is formed integrally with the front surface of the cover body in an area around the bearing surface of the nut member so as to extend in a circumferential direction of the bearing surface of the nut member. The urethane resin composition is foamed in the second mold cavity after the cover body is placed in the second mold cavity in a manner such that an end portion of the loop-shaped projection is brought into contact with a second cavity surface of the second mold.

In another preferred embodiment of the method of manufacturing the soundproofing cover according to the present invention, the dummy bolt is formed of a ferromagnetic material and the attracting means includes a permanent magnet fixed to the first mold. The dummy bolt is attracted to the attracting means by an attraction force generated by the permanent magnet, so that the dummy bolt is retained in the first mold. When the first mold is opened, the cover body is removed from the first cavity surface by a force greater than the attracting force applied to the dummy bolt by the permanent magnet. Accordingly, the dummy bolt is released from the state in which the dummy bolt is retained in the first mold by being attracted to the attracting means.

The attracting means may include an electromagnet or a vacuum device (negative-pressure generating device) that sucks in air instead of the permanent magnet. In the case where the attracting means includes an electromagnet or a vacuum device, when, for example, the first mold is opened, the dummy bolt can be released from the state in which the dummy bolt is retained in the first mold by being attracted to the attracting means by stopping the supply of electricity to the electromagnet or by stopping the operation of the vacuum device.

In another preferred embodiment of the method of manufacturing the soundproofing cover according to the present invention, the first cavity surface has a receiving recess for receiving the portion of the nut member including the bearing surface at the first end in the axial direction and a portion of the dummy bolt fastened to the nut member that projects from the bearing surface. The dummy bolt is retained in the first mold in a manner such that the bearing surface of the nut member is arranged in the receiving recess at a position deeper than the bottom surface of the loop-shaped groove.

With the soundproofing cover according to the present invention, a component or a member to be attached to an object covered by the soundproofing cover can be reliably attached to the cover body by fastening a screw, a bolt, or the like to the nut member embedded in the cover body. Therefore, unlike the soundproofing cover according to the related art, a through hole for allowing a boss portion formed on the object covered by the soundproofing cover to extend therethrough can be omitted. Therefore, leakage of noise through the gap between the inner peripheral surface of the through hole and the outer peripheral surface of the boss portion can be effectively reduced. In addition, an economic advantage can be realized since an inexpensive nut member having a threaded hole that opens at both sides of the nut member in the axial direction is used as the nut member embedded in the cover body.

In the soundproofing cover according to the present invention, of the openings of the threaded hole at both sides of the nut member in the axial direction, the opening that is closer to the back surface of the cover body is blocked by the blocking portion that is formed integrally with the cover body. Therefore, when the sound absorbing layer is formed integrally with the back surface of the cover body, the urethane resin composition is effectively prevented from entering the threaded hole in the nut member through the opening of the threaded hole at the side closer to the back surface of the cover body. If the urethane resin composition is solidified in the threaded hole, it will be difficult to fasten the screw, bolt, or the like to the nut member, owing to the solidified urethane foam. However, such a situation can be prevented.

Thus, the soundproofing cover according to the present invention has a sufficiently high soundproofing performance and allows another member to be reliably attached to the cover body with a screw-fastening structure.

According to the method of manufacturing the soundproofing cover according to the present invention, the nut member is fastened to the dummy bolt, which is independent of the first mold, and is retained in the first mold by the dummy bolt. Injection molding is performed in this state, so that the cover body in which the nut member is embedded is formed. Then, the cover body is removed from the first mold together with the dummy bolt, and then the dummy bolt is removed from the nut member embedded in the cover body.

In the method according to the present invention, the dummy bolt advantageously prevents the molten resin that is injected into the first mold to form the cover body from flowing into the threaded hole in the nut member. Accordingly, the blocking portion, which blocks one of the openings of the threaded hole at both sides of the nut member in the axial direction that is closer to the back surface of the cover body, is reliably formed integrally with the cover body when the cover body is formed. Unlike the case in which the dummy bolt is formed integrally with the first mold, the dummy bolt can be easily and quickly removed from the nut member embedded in the cover body simply by rotating the small dummy bolt instead of rotating the entire body of the first mold or the entire body of the cover body after the cover body is formed. This simplifies the manufacturing process of the cover body and increases the manufacturing efficiency.

Thus, according to the method of manufacturing the soundproofing cover of the present invention, the soundproofing cover having the above-described advantageous features can be extremely easily and efficiently manufactured.

DESCRIPTION OF THE PREFERRED EMBODIMENTS

Embodiments of the present invention will now be described in detail below with reference to the drawings to further clarify the present invention.

Figure 1:
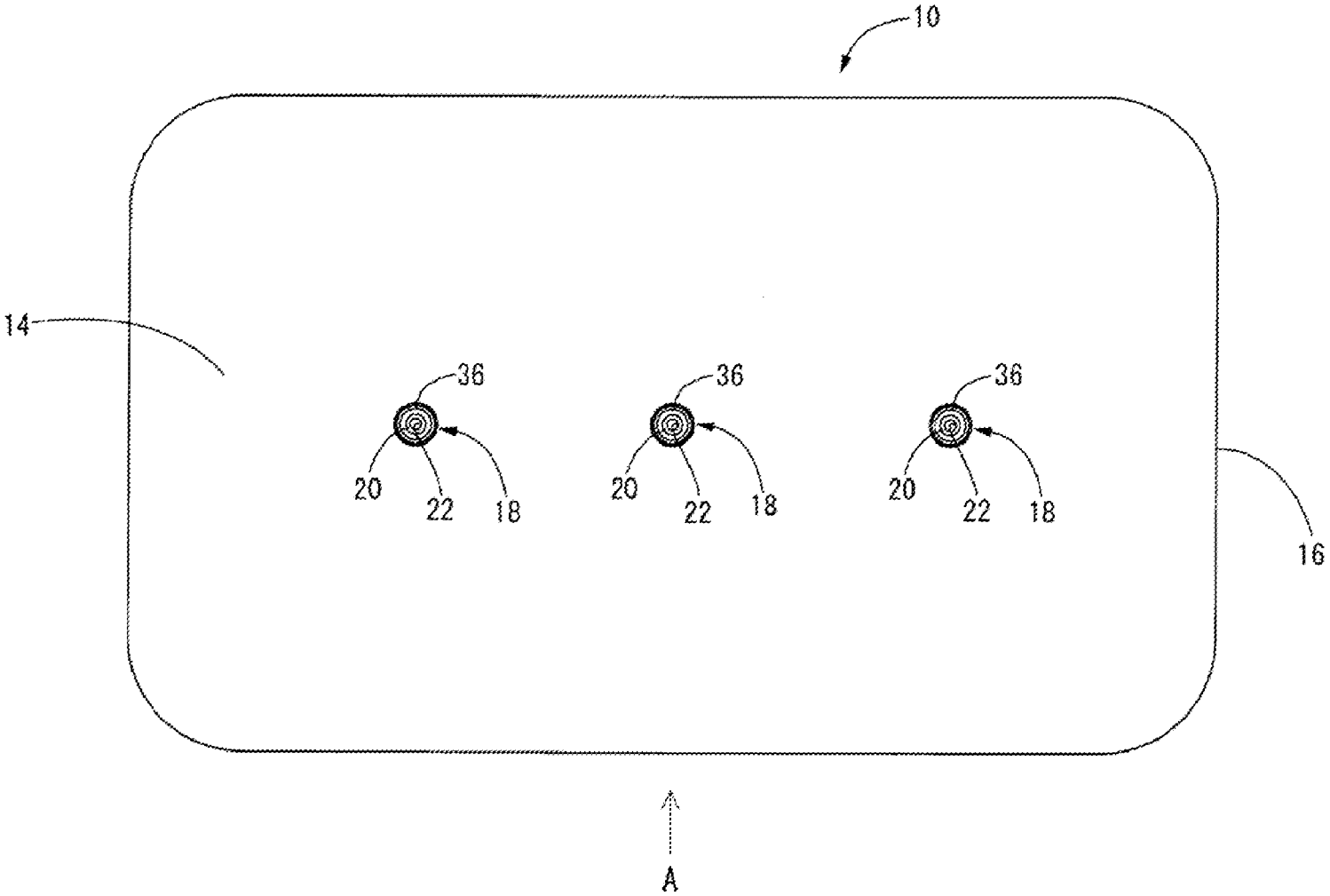
FIG. 1 is a top view of a soundproofing cover according to an embodiment of the present invention.
Figure 2:
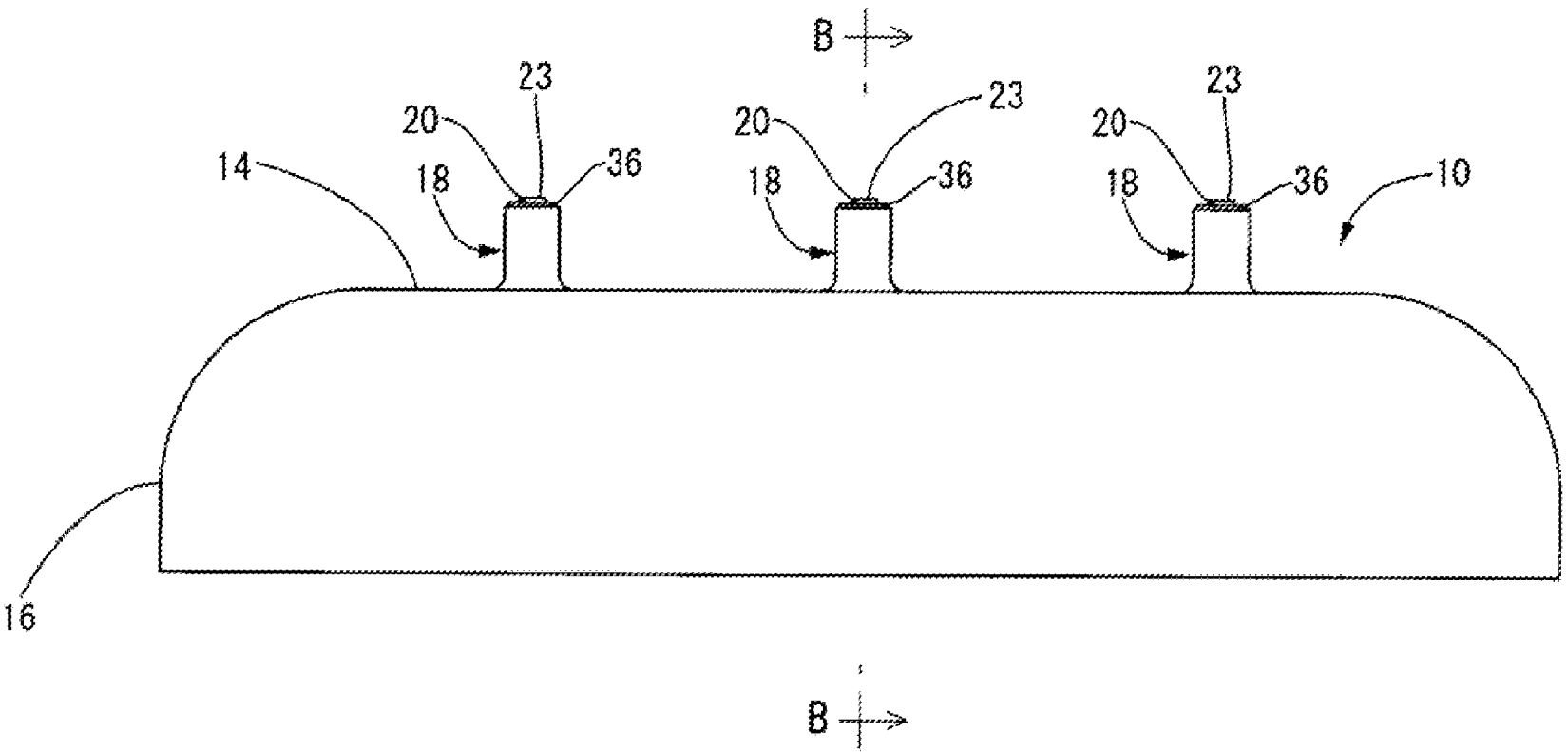
FIG. 2 illustrates the soundproofing cover viewed in a direction shown by arrow A in FIG. 1.
Figure 3:
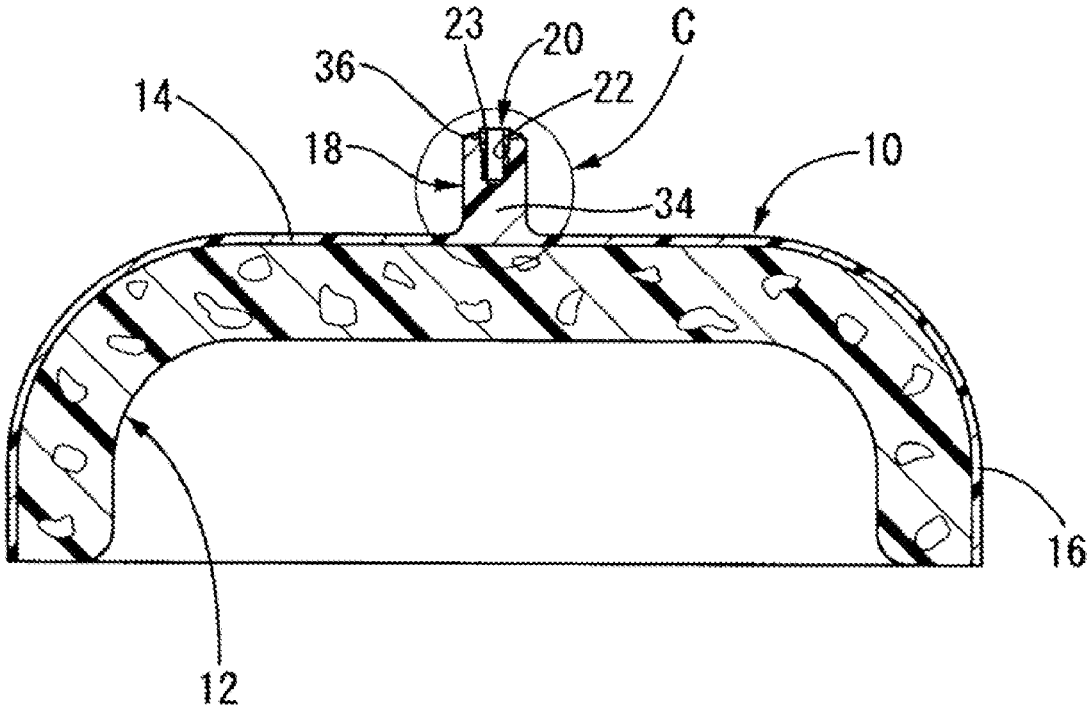
FIG. 3 is a sectional view of FIG. 2 taken along line B-B.

FIG. 1 is a top view of a soundproofing cover having the structure according to an embodiment of the present invention. The soundproofing cover covers a cylinder head cover of a vehicle engine. FIG. 2 is a side view of the soundproofing cover and FIG. 3 is a vertical sectional view of the soundproofing cover. As is clear from FIGS. 1 to 3, the soundproofing cover according to the present embodiment includes a cover body 10 and a sound absorbing layer 12.

More specifically, the cover body 10 has the shape of a rectangular housing as a whole, and includes a thin plate-shaped top plate portion 14 and a thin frame-shaped side wall portion 16 that are formed integrally with each other. The cover body 10 may be made of a hard resin material. In particular, the cover body 10 may be made of polyamide, which has high heat resistance and strength. The resin material of the cover body 10 is not particularly limited as long as the resin material is hard. In addition to polyamide, materials such as polyethylene terephthalate and polypropylene, which have been commonly used as materials for resin-made soundproofing covers, may be used as appropriate.

The sound absorbing layer 12 has the shape of a rectangular housing that is somewhat smaller than the cover body 10 and sufficiently thicker than the cover body 10. The sound absorbing layer 12 is formed of a soft urethane foam formed by foaming a urethane resin composition. The front surface of the sound absorbing layer 12 is integrally bonded or fixed to the back surface of the cover body 10.

Thus, the soundproofing cover according to the present embodiment is formed as an integral body in which the cover body 10 and the sound absorbing layer 12 are bonded together. Although not illustrated, the soundproofing cover is arranged so as to entirely cover the upper section of the cylinder head cover of the vehicle engine in a manner such that the back surface of the sound absorbing layer 12 is in tight contact with the front surface of the cylinder head cover. In such an arrangement, the soundproofing cover is fixed to the cylinder head cover with bolts with a rubber mount or the like interposed therebetween, as described in, for example, Japanese Unexamined Patent Application Publications No. 2003-50585 and No. 10-332076. Accordingly, noise generated in the engine is absorbed by the sound absorbing layer 12. In addition, vibration of the cover body 10 caused by vibration of the engine can also be absorbed by the sound absorbing layer 12. As a result, high soundproofing performance is achieved. To achieve sufficiently high sound-absorbing effect, the apparent density of the sound absorbing layer 12 is preferably about 0.06 to 0.12 g/cm$^3$, and the thickness thereof is preferably 5 mm or more.

The soundproofing cover according to the present embodiment has a specific structure such that when the soundproofing cover is attached to the cylinder head cover and placed in an engine room, components around the soundproofing cover can be attached to the soundproofing cover.

More specifically, in the soundproofing cover according to the present embodiment, three boss portions 18 are arranged on a front surface (top surface) of the top plate portion 14 in a central area thereof in a width direction (vertical direction in FIG. 1). The boss portions 18 are formed integrally with the top plate portion 14 and are arranged at constant intervals along a length direction of the top plate portion 14 (horizontal direction in FIG. 1). Each of the three boss portions 18 has a substantially columnar shape as a whole. A single nut member 20 is embedded in each boss portion 18.

Figure 4:
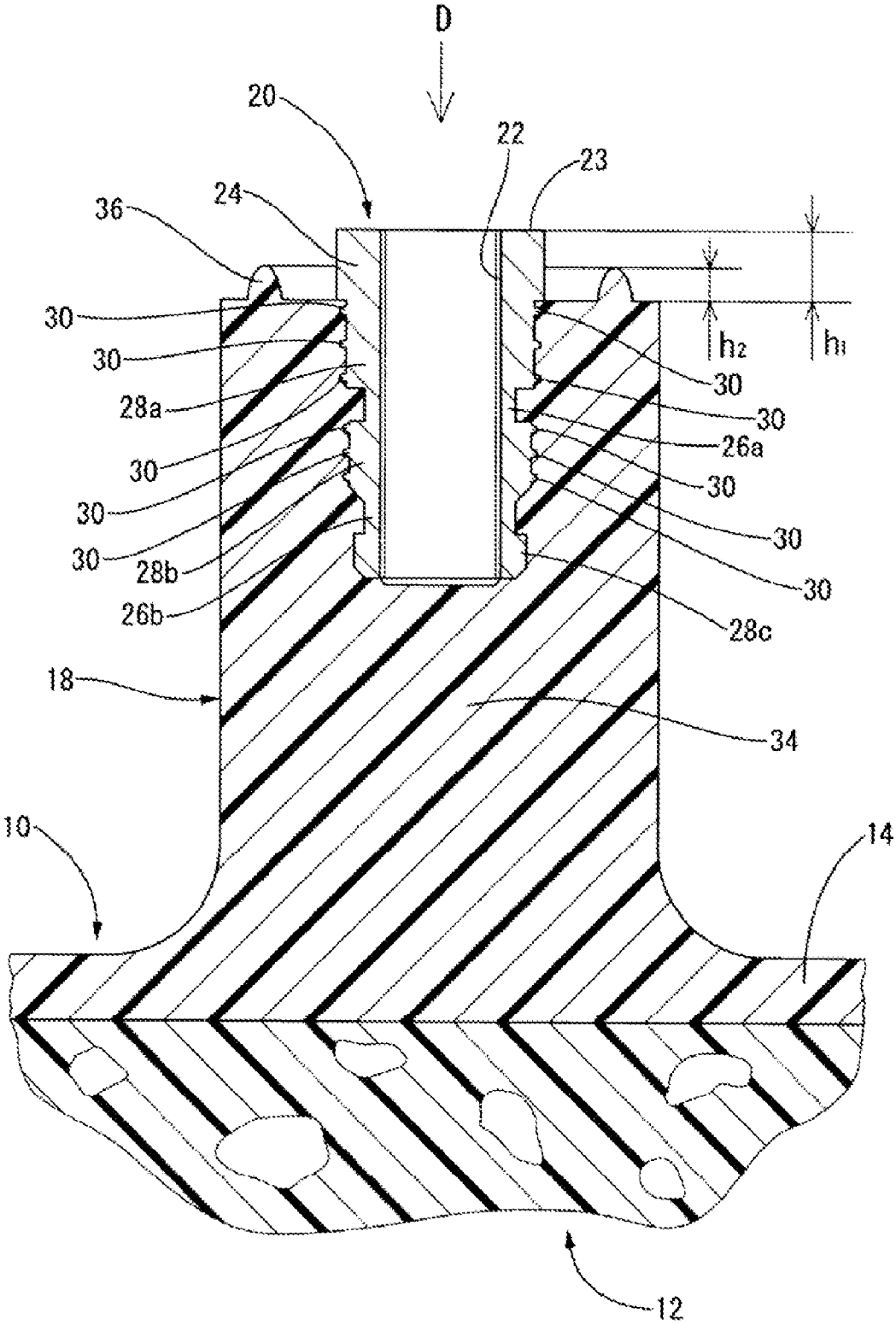
FIG. 4 is an enlarged view of part C in FIG. 3.
Figure 5:
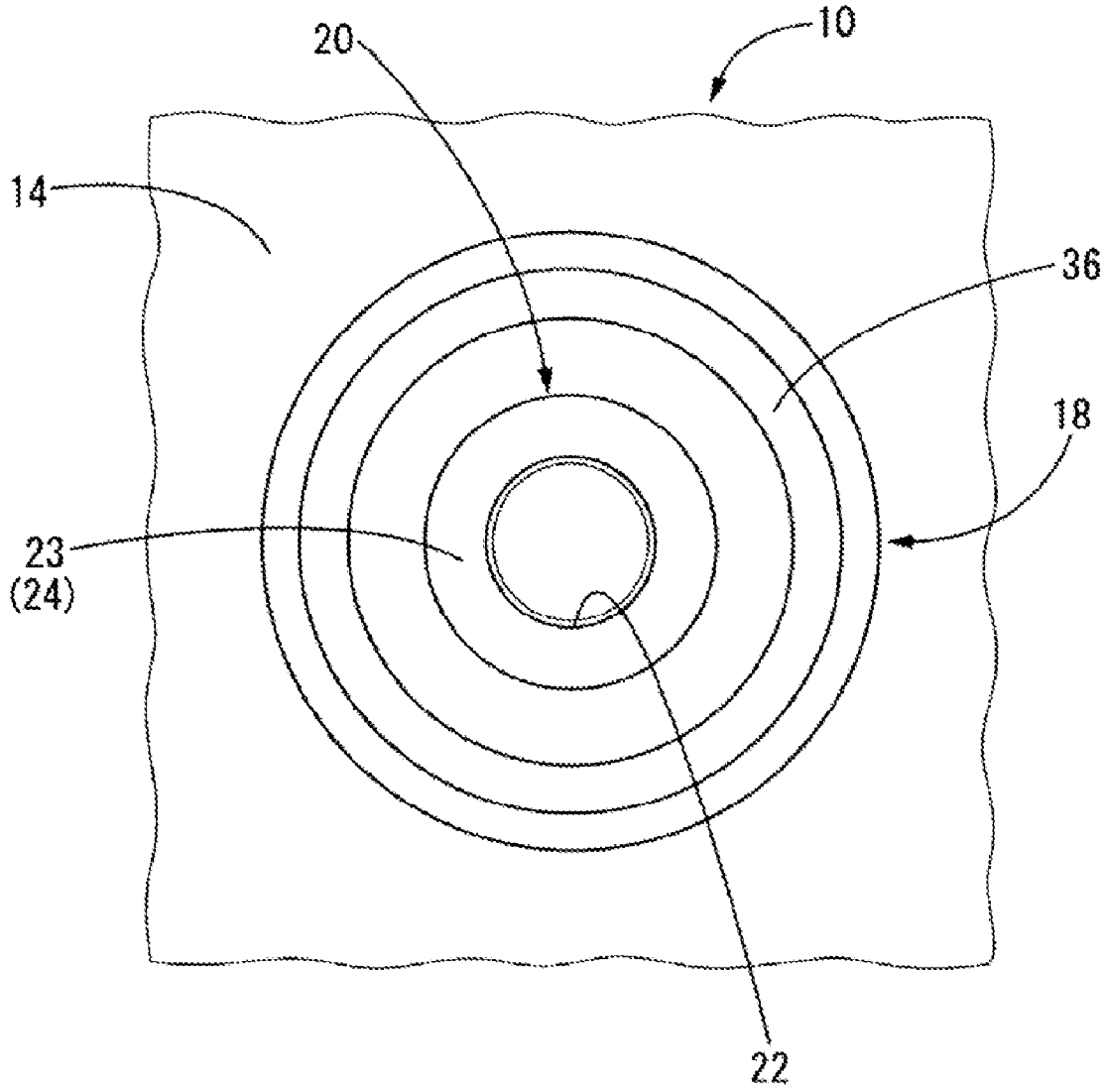
FIG. 5 illustrates a part of the soundproofing cover viewed in a direction shown by arrow D in FIG. 5.
Figure 6:
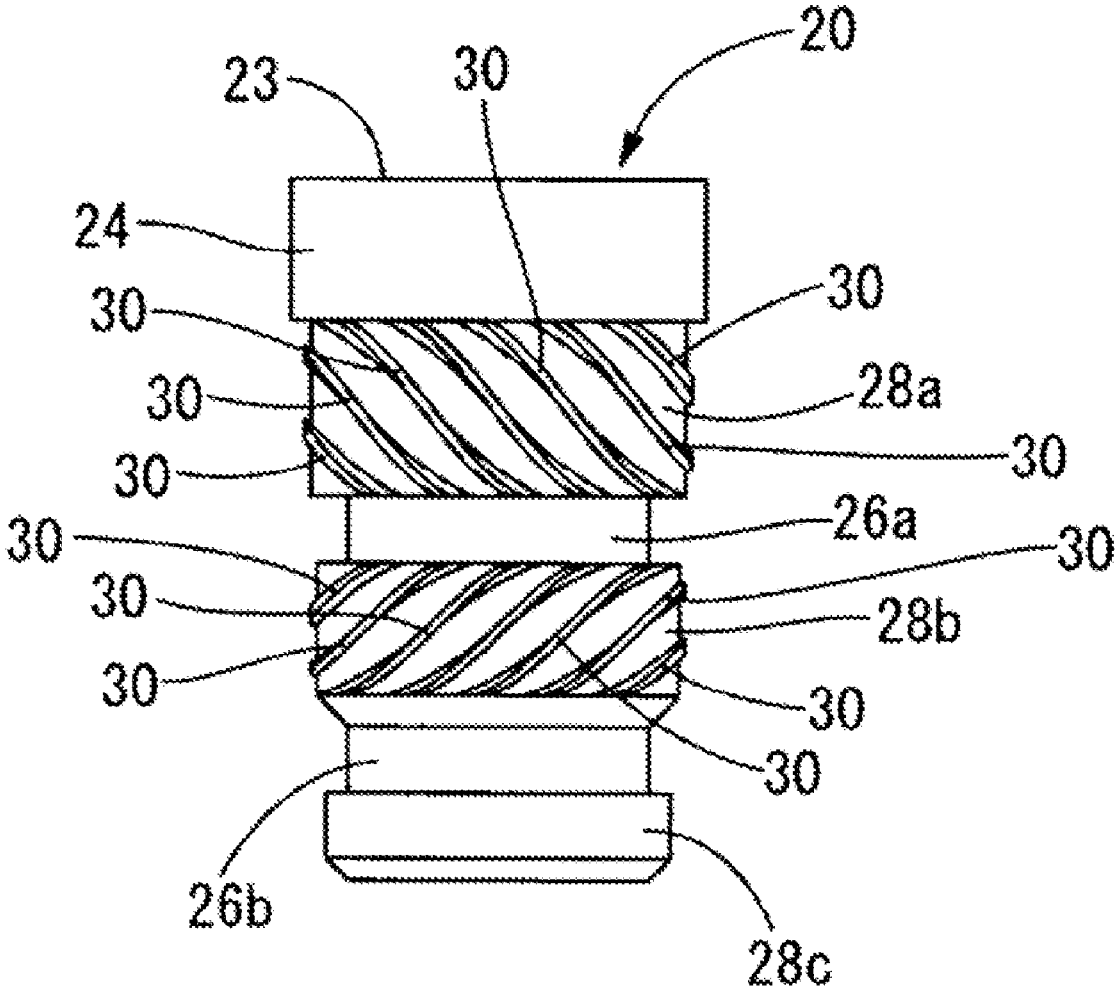
FIG. 6 is a front view of a nut member that is embedded in a cover body of the soundproofing cover illustrated in FIG. 1.

As illustrated in FIGS. 4 to 6, each nut member 20 has a substantially cylindrical shape as a whole with a smaller height and a smaller diameter than those of each boss portion 18. The entire area of the inner hole in the nut member 20 is formed as a threaded hole 22 that opens at both sides of the nut member 20 in an axial direction thereof. The nut member 20 is formed of a relatively soft metal material, such as brass.

Therefore, as described below, when a bolt or the like that is screwed into the threaded hole 22 is sufficiently tightly fastened, the nut member 20 expands radially while contracting in the axial direction, owing to a compressive force applied to the nut member 20 in the axial direction in response to an axial force applied by the bolt or the like.

The top end surface of the nut member 20 serves as a bearing surface 23. A top end portion of the nut member 20 including the bearing surface 23 is formed as a large-diameter portion 24 having a diameter larger than those of the other portions. Two small-diameter portions 26*a* and 26*b* are formed in an axially intermediate area below the large-diameter portion 24. The small-diameter portions 26*a* and 26*b* are vertically (axially) spaced from each other. A portion above the small-diameter portion 26*a*, which is the upper one of the two small-diameter portions 26*a* and 26*b*, is defined as an upper intermediate-diameter portion 28*a*. A portion between the two small-diameter portions 26*a* and 26*b* is defined as an intermediate intermediate-diameter portion 28*b*. A portion below the small-diameter portion 26*b*, which is the lower one of the two small-diameter portions 26*a* and 26*b*, is defined as a lower intermediate-diameter portion 28*c*.

A large number of biting projections 30 are formed integrally with the outer peripheral surfaces of the upper intermediate-diameter portion 28*a* and the intermediate intermediate-diameter portion 28*b*. The biting projections 30 are formed of projections that have a trapezoidal shape in vertical cross section and that extend helically along a circumferential direction of the upper and intermediate intermediate-diameter portions 28*a* and 28*b*. Each biting projection 30 formed on the upper intermediate-diameter portion 28*a* and each biting projection 30 formed on the intermediate intermediate-diameter portion 28*b* helically extend in opposite directions along the circumferential direction. As is clear from the above, in the present embodiment, each biting projection 30 formed on the upper intermediate-diameter portion 28*a* serves as a first helical biting projection, and each biting projection 30 formed on the intermediate intermediate-diameter portion 28*b* serves as a second helical biting projection. The biting projections 30 may be easily formed by, for example, subjecting the outer peripheral surfaces of the upper and intermediate intermediate-diameter portions 28*a* and 28*b* to knurling.

The nut member 20 having the above-described structure is coaxially embedded in each boss portion 18 in a manner such that the large-diameter portion 24 projects from the end surface of the boss portion 18. Thus, the bearing surface 23 of the nut member 20 is externally exposed at a position higher than the end surface of the boss portion 18 by a distance corresponding to the height dimension (dimension indicated by h1 in FIG. 4) of the large-diameter portion 24. Accordingly, a bolt, a screw, etc., may be screwed into the threaded hole 22 in the nut member 20, which is embedded in the boss portion 18, through the opening of the threaded hole 22 at the top side (front side) thereof.

In this manner, when the soundproofing cover according to the present embodiment is attached to the cylinder head cover and placed in the engine room, components around the soundproofing cover can be attached to the soundproofing cover with a screw-fastening structure by fastening a screw, a bolt, etc., to the nut member 20 in each boss portion 18.

In this soundproofing cover, the lower intermediate-diameter portion 28*c* of the nut member 20 embedded in the boss portion 18 is located at an intermediate position of the boss portion 18 in the height direction thereof. Accordingly, the opening of the threaded hole 22 in the nut member 20 at the bottom side (back side) thereof is blocked by a base portion of the boss portion 18 that is positioned below the nut member 20. Thus, the base portion of the boss portion 18 serves as a blocking portion 34 that blocks the opening of the threaded hole 22 in the nut member 20 at the bottom side thereof.

The biting projections 30 on the outer peripheral surfaces of the upper and intermediate intermediate-diameter portions 28*a* and 28*b* of the nut member 20 are formed so as to bite into the inner peripheral surface of the hole in the boss portion 18 in which the nut member 20 is embedded. The biting projections 30 are formed integrally with the outer peripheral surface of the nut member 20 made of metal, and are therefore sufficiently harder than the boss portion 18 made of resin.

Thus, the nut member 20 is embedded in the boss portion 18 in a state such that an anchoring effect is achieved by the biting projections 30 that bite into the inner peripheral surface of the hole in the boss portion 18. The outer peripheral surface of a part of the nut member 20 that is embedded in the boss portion 18 has a stepped shape in which the intermediate-diameter portions 28*a*, 28*b* and 28*c* and the small-diameter portions 26*a* and 26*b* are alternately arranged. Accordingly, the nut member 20 is reliably prevented from being pulled out from the boss portion 18. In addition, the direction in which the biting projections 30 on the upper intermediate-diameter portion 28*a* extend and the direction in which the biting projections 30 on the intermediate intermediate-diameter portion 28*b* extend are opposite to each other. Therefore, the nut member 20 can be effectively prevented from being dragged by a bolt or the like when the bolt or the like is tightened or loosened in the threaded hole 22.

In addition, as described above, the nut member 20 expands radially while contracting in the axial direction when the bolt or the like is tightly fastened. Therefore, when the bolt or the like is sufficiently tightly fastened to the nut member 20 embedded in the boss portion 18, the biting projections 30 on the outer peripheral surface of the nut member 20 bite deeper into the inner peripheral surface of the hole in the boss portion 18 by an amount corresponding to the amount of radial expansion of the nut member 20. As a result, the anchoring effect achieved by the biting projections 30 is enhanced. Thus, the nut member 20 is more strongly fixed to the boss portion 18 and the nut member 20 is more effectively prevented from being pulled out from the boss portion 18.

In the soundproofing cover according to the present embodiment, a loop-shaped projection 36 is formed integrally with the end surface of the boss portion 18 in which the nut member 20 is embedded. The loop-shaped projection 36 is formed of an annular projection having a U-shaped or semielliptical cross section. The loop-shaped projection 36 has an inner diameter that is larger by a predetermined dimension than the diameter of the large-diameter portion 24 of the nut member 20, and is arranged so as to surround the large-diameter portion 24. In other words, the loop-shaped projection 36 is formed integrally with the end surface of the boss portion 18 in an area around the bearing surface 23 of the nut member 20 so as to project from the end surface of the boss portion 18 and extend in a circumferential direction of the bearing surface 23.

As illustrated in FIG. 4, a projection height h2 to which the loop-shaped projection 36 projects from the end surface of the boss portion 18 is smaller than the height h1 of the bearing surface 23 of the nut member 20 from the end surface of the boss portion 18, that is, the height dimension of the large-diameter portion 24 of the nut member 20. Accordingly, when the bolt or the like is screwed or fastened to the threaded hole 22 in the nut member 20 embedded in the boss portion 18, the head of the bolt or the like can be prevented from coming into contact with the end surface of the loop-shaped projection 36.

Therefore, the head of the bolt or the like reliably comes into tight contact with the bearing surface 23 of the nut member 20 without being obstructed by the loop-shaped projection 36. As a result, the axial force of the bolt or the like is stably and reliably generated when the bolt or the like is fastened to the nut member 20. Therefore, loosening of the bolt or the like is effectively prevented.

The difference h1−h2 between the height h1 of the bearing surface 23 of the nut member 20 from the end surface of the boss portion 18 and the projection height h2 of the loop-shaped projection 36 from the end surface of the boss portion 18 is not particularly limited. However, as described above, the nut member 20 contracts in the axial direction when the bolt or the like is fastened thereto. Therefore, the difference h1−h2 is preferably greater than the amount by which the nut member 20 contracts when the bolt or the like is fastened. More specifically, the difference h1−h2 is preferably about 0.2 to 1.5 mm.

If the difference h1−h2 between the height h1 of the bearing surface 23 of the nut member 20 from the end surface of the boss portion 18 and the projection height h2 of the loop-shaped projection 36 from the end surface of the boss portion 18 is less than 0.2 mm, the head of the bolt or the like may come into contact with the loop-shaped projection 36 before the bolt or the like is sufficiently tightly fastened to the nut member 20. In such a case, there is a risk that the bolt or the like cannot be sufficiently tightly fastened. If the difference h1−h2 is more than 1.5 mm, the axial length of the part of the nut member 20 that is embedded in the boss portion 18 is reduced. As a result, there is a risk that the fixing strength with which the nut member 20 is fixed to the boss portion 18 will be reduced. For the above reasons, the difference h1−h2 is preferably about 0.2 to 1.5 mm. More preferably, the difference h1−h2 is about 0.5 to 1.0 mm. It is to be noted that, in FIGS. 2 to 4 and other drawings described below, the height of the bearing surface 23 of the nut member 20 and the height of the end surface of the loop-shaped projection 36 are exaggerated. The bearing surface 23 and the end surface of the loop-shaped projection 36 are drawn at positions higher than the actual heights.

The soundproofing cover of the present embodiment having the above-described structure is manufactured by, for example, the following method. That is, first, the cover body 10 is formed by injection molding. Then, the sound absorbing layer 12 made of the urethane foam is formed integrally with the back surface of the cover body 10 by foaming a urethane resin composition in a mold in which the cover body 10 is placed. In the method of manufacturing the soundproofing cover, a first mold 38 having the structure illustrated in FIG. 7 is preferably used in the injection molding for forming the cover body 10.

Figure 7:
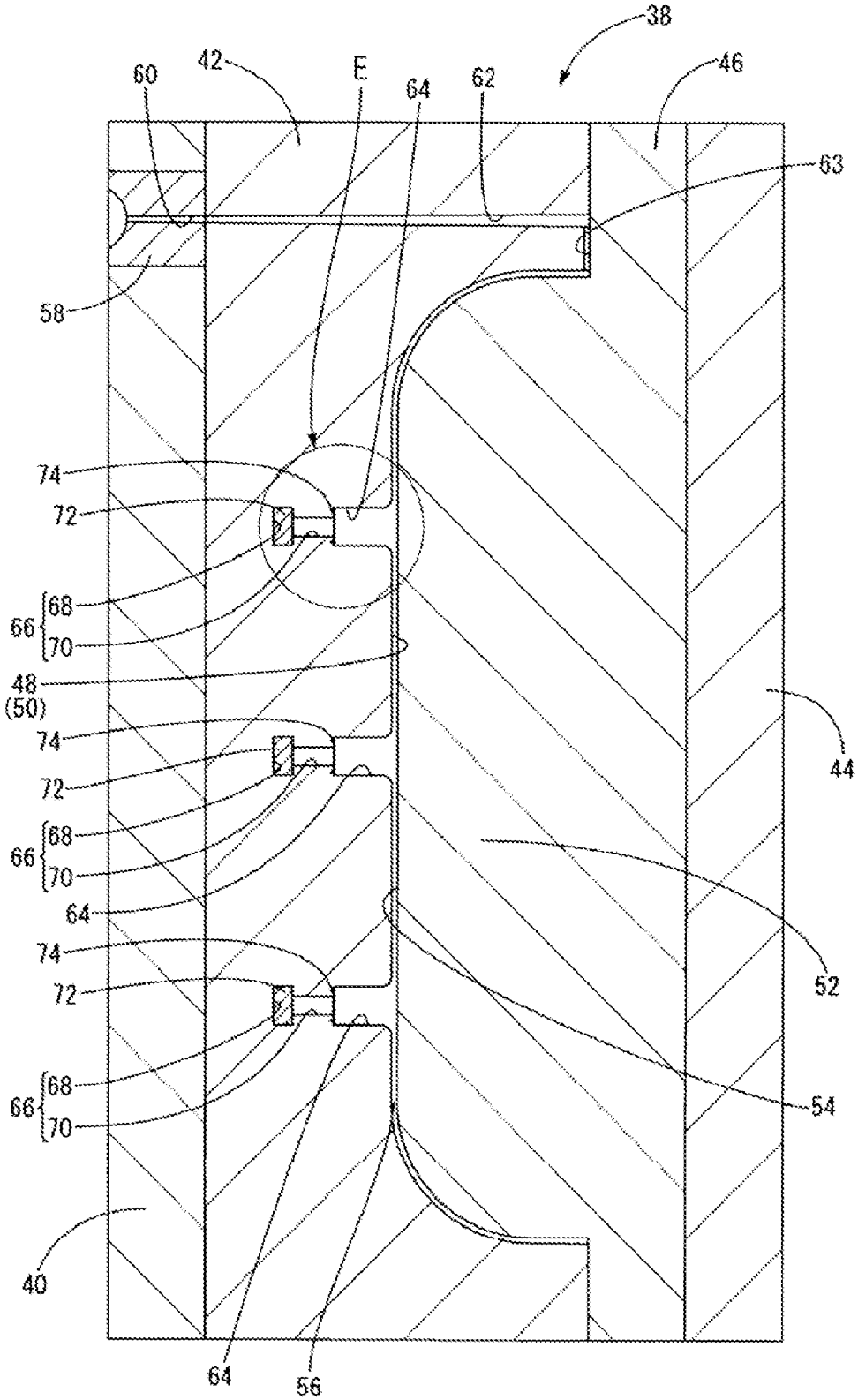
FIG. 7 is a vertical sectional view of a mold used to manufacture the soundproofing cover illustrated in FIG. 1 by a method according to the present invention.

As illustrated in FIG. 7, the first mold 38 includes a fixed mold piece 42 and a movable mold piece 46. The fixed mold piece 42 is attached to a stationary plate 40, which is stationary. The movable mold piece 46 is attached to a movable plate 44, which is movable towards and away from the stationary plate 40, and is opposed to the fixed mold piece 42.

In the first mold 38, a cavity-forming recess 48 is formed in a surface of the fixed mold piece 42 that faces the movable mold piece 46. The entire area of the inner surface of the cavity-forming recess 48 serves as a fixed-mold-piece cavity surface 50, which is a first cavity surface. The fixed-mold-piece cavity surface 50 has a shape that corresponds to the shape of the front surface of the cover body 10. A cavity-forming projection 52 that can be inserted into the cavity-forming recess 48 in the fixed mold piece 42 is integrally formed on a surface of the movable mold piece 46 that faces the fixed mold piece 42. The entire area of the outer surface of the cavity-forming projection 52 serves as a movable-mold-piece cavity surface 54 that has a shape corresponding to the shape of the back surface of the cover body 10.

When the movable mold piece 46 and the fixed mold piece 42 are put together so that the cavity-forming projection 52 on the movable mold piece 46 is inserted into the cavity-forming recess 48 in the fixed mold piece 42, a first mold cavity 56 is formed between the fixed-mold-piece cavity surface 50 and the movable-mold-piece cavity surface 54. The first mold cavity 56 has a shape corresponding to the external shape of the cover body 10.

A sprue bushing 58 that comes into contact with a nozzle of an injection molding machine (not shown) is formed in the stationary plate 40 of the first mold 38. A sub-sprue 62 and a gate 63 that opens into the first mold cavity 56 are formed in the fixed mold piece 42 so as to communicate with a sprue 60 in the sprue bushing 58. Accordingly, a molten resin material ejected from the nozzle is guided into the first mold cavity 56 through the sprue 60, the sub-sprue 62 and the gate 63.

Figure 8:
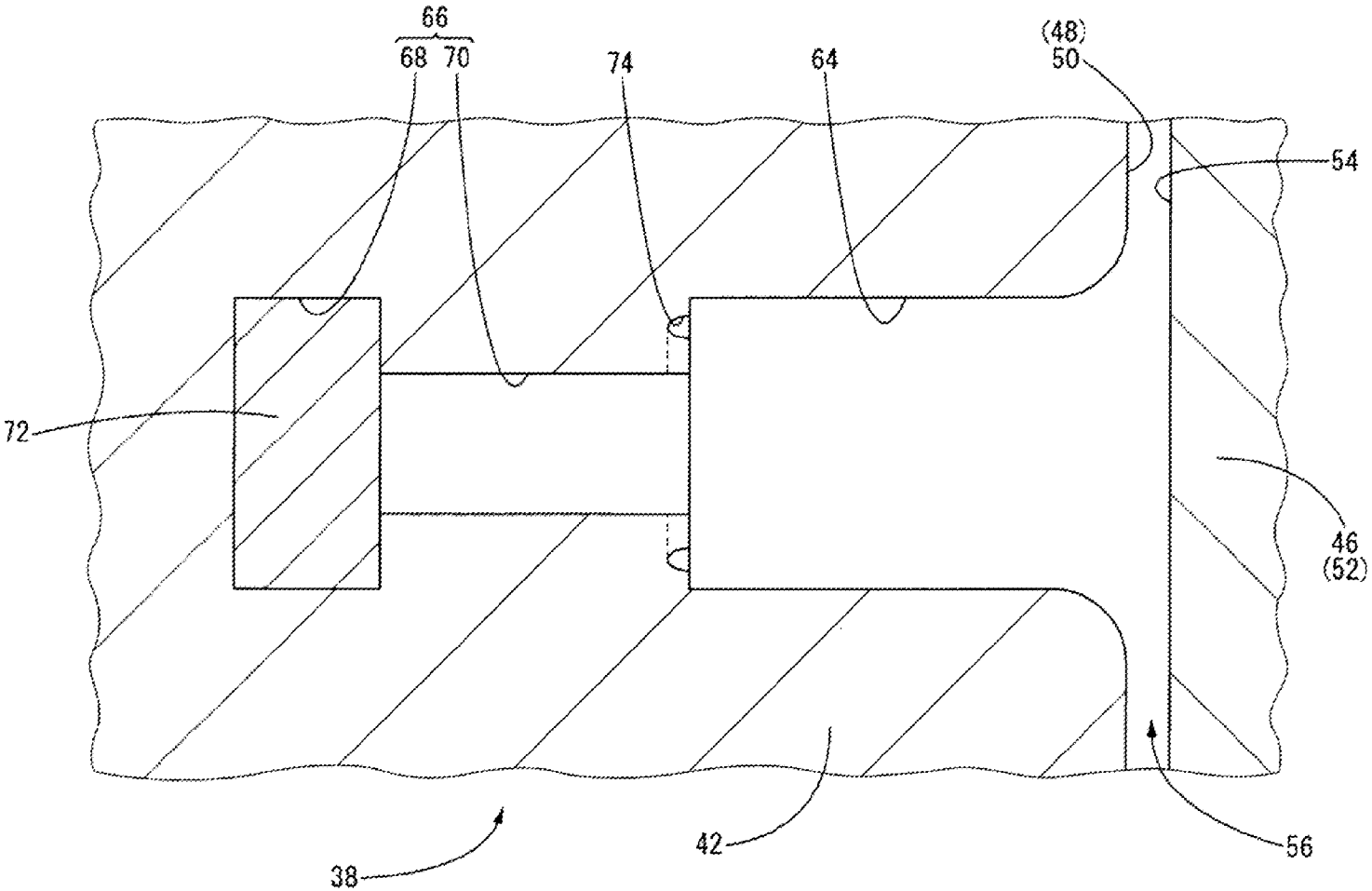
FIG. 8 is an enlarged view of part E in FIG. 7.

Three boss-portion-forming recesses 64, which serve as recesses, are formed along a line in the fixed-mold-piece cavity surface 50 of the fixed mold piece 42 in a substantially central area thereof. The internal shape of the boss-portion-forming recesses 64 corresponds to the shape of the three boss portions 18 to be formed integrally with the cover body 10. As illustrated in FIGS. 7 and 8, each boss-portion-forming recess 64 has a receiving recess 66 that opens in the bottom surface of the boss-portion-forming recess 64 at a central area thereof. The receiving recess 66 has a stepped cylindrical inner surface such that the diameter of a part of the receiving recess 66 that is closer to the opening thereof is smaller than the diameter of a part of the receiving recess 66 that is closer to the bottom side thereof. The part of the receiving recess 66 that is closer to the bottom side thereof and has a large diameter is defined as a magnet-receiving section 68, and the part of the receiving recess 66 that is closer to the opening thereof and has a small diameter is defined as a dummy-bolt-receiving section 70. A single permanent magnet 72, which serves as attracting means, is placed in the magnet-receiving section 68 of each receiving recess 66 in a non-removable manner.

An annular loop-shaped groove 74 is formed in the bottom surface of each boss-portion-forming recess 64 at an outer peripheral area thereof. The loop-shaped groove 74 extends in a circumferential direction of the opening of the receiving recess 66. The internal shape of the loop-shaped groove 74 corresponds to the external shape of the loop-shaped projection 36 to be formed integrally with the end surface of the boss portion 18.

The cover body 10 is formed by using the first mold 38 having the above-described structure in accordance with, for example, the following procedure.

Figure 9:
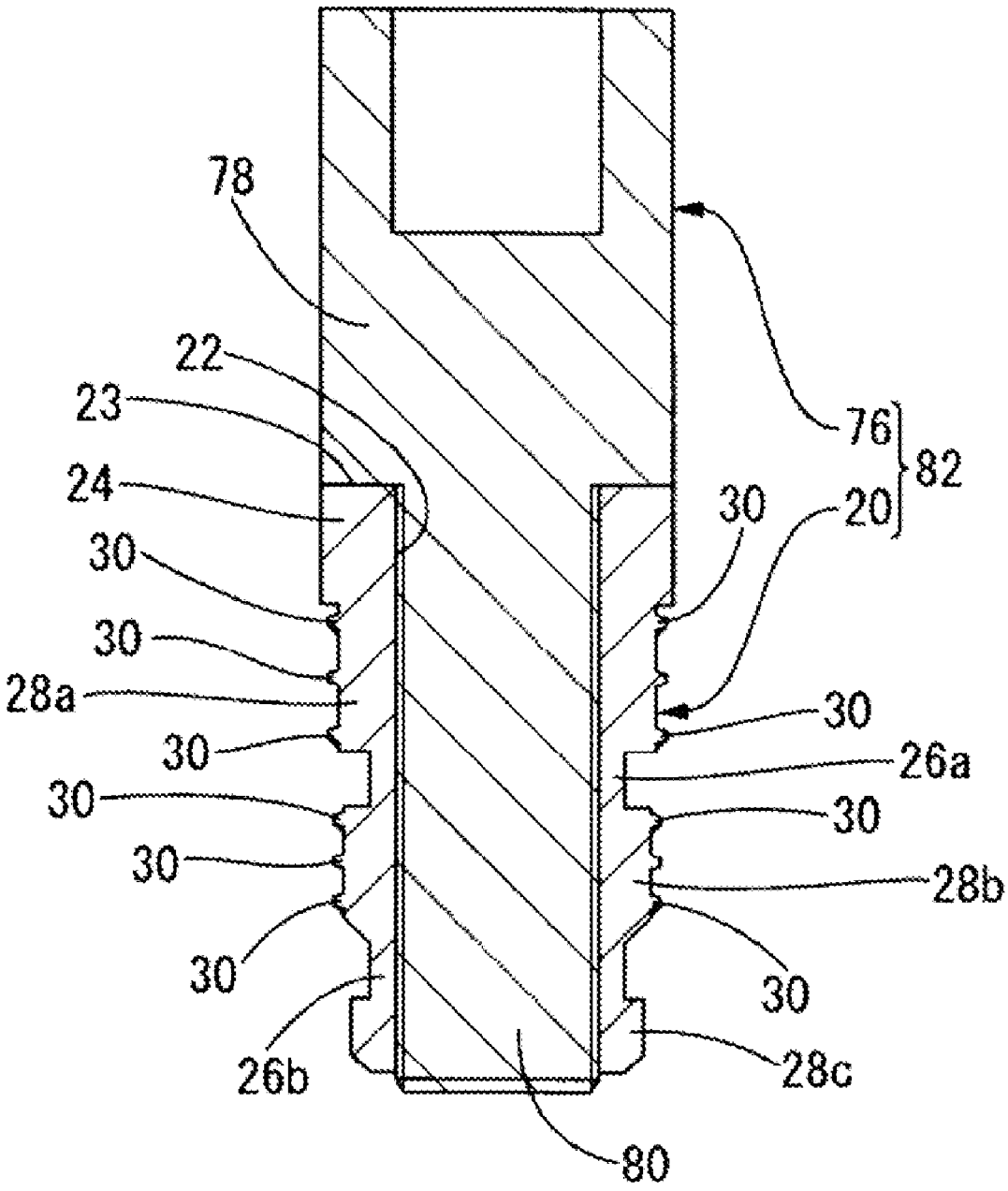
FIG. 9 is a vertical sectional view illustrating the state in which a dummy bolt is screwed into the nut member in the process of manufacturing the soundproofing cover illustrated in FIG. 1 by the method according to the present invention.

That is, first, three nut members 20 having the structure illustrated in FIG. 6 are prepared. Then, as illustrated in FIG. 9, a single dummy bolt 76 is attached to each of the three nut members 20.

Each dummy bolt 76 is formed of a ferromagnetic material that is attracted to the permanent magnet 72, and includes a substantially columnar head portion 78 that has a large diameter and an externally threaded portion 80 that has a small diameter. The externally threaded portion 80 is integrated with the head portion 78 and projects from the bottom end of the head portion 78. The outer diameter of the head portion 78 of the dummy bolt 76 is set so that the head portion 78 can be placed in the dummy-bolt-receiving section 70 of the receiving recess 66 formed in the fixed mold piece 42 of the first mold 38. The axial length of the head portion 78 is set to be smaller by a certain length than the axial length (depth) of the dummy-bolt-receiving section 70. A recess is formed in the end surface of the head portion 78 at a central area thereof, so that the area of the end face is reduced. Accordingly, as described below, the area of the surface of the dummy bolt 76 that comes into contact with the permanent magnet 72 when the dummy bolt 76 is attracted to the permanent magnet 72 is reduced. The externally threaded portion 80 can be screwed into the threaded hole 22 in the nut member 20. The axial length of the externally threaded portion 80 is substantially the same as or slightly greater than the axial length of the nut member 20 (see FIG. 12).

The externally threaded portion 80 of the dummy bolt 76 is screwed into the threaded hole 22 in the nut member 20 through the opening that opens into the bearing surface 23 of the large-diameter portion 24. The externally threaded portion 80 is screwed into the threaded hole 22 until the bottom end surface of the head portion 78 comes into contact with the bearing surface 23 of the nut member 20. In this manner, three assemblies 82 in each of which, the dummy bolt 76 is attached to the nut member 20 are formed. In each assembly 82, the externally threaded portion 80 very slightly projects from the opening of the threaded hole 22 at the side opposite to the bearing surface 23. Thus, the end surface of the externally threaded portion 80 and the end surface of the nut member 20 at the side opposite to the bearing surface 23 are substantially flush with each other.

Figure 10:
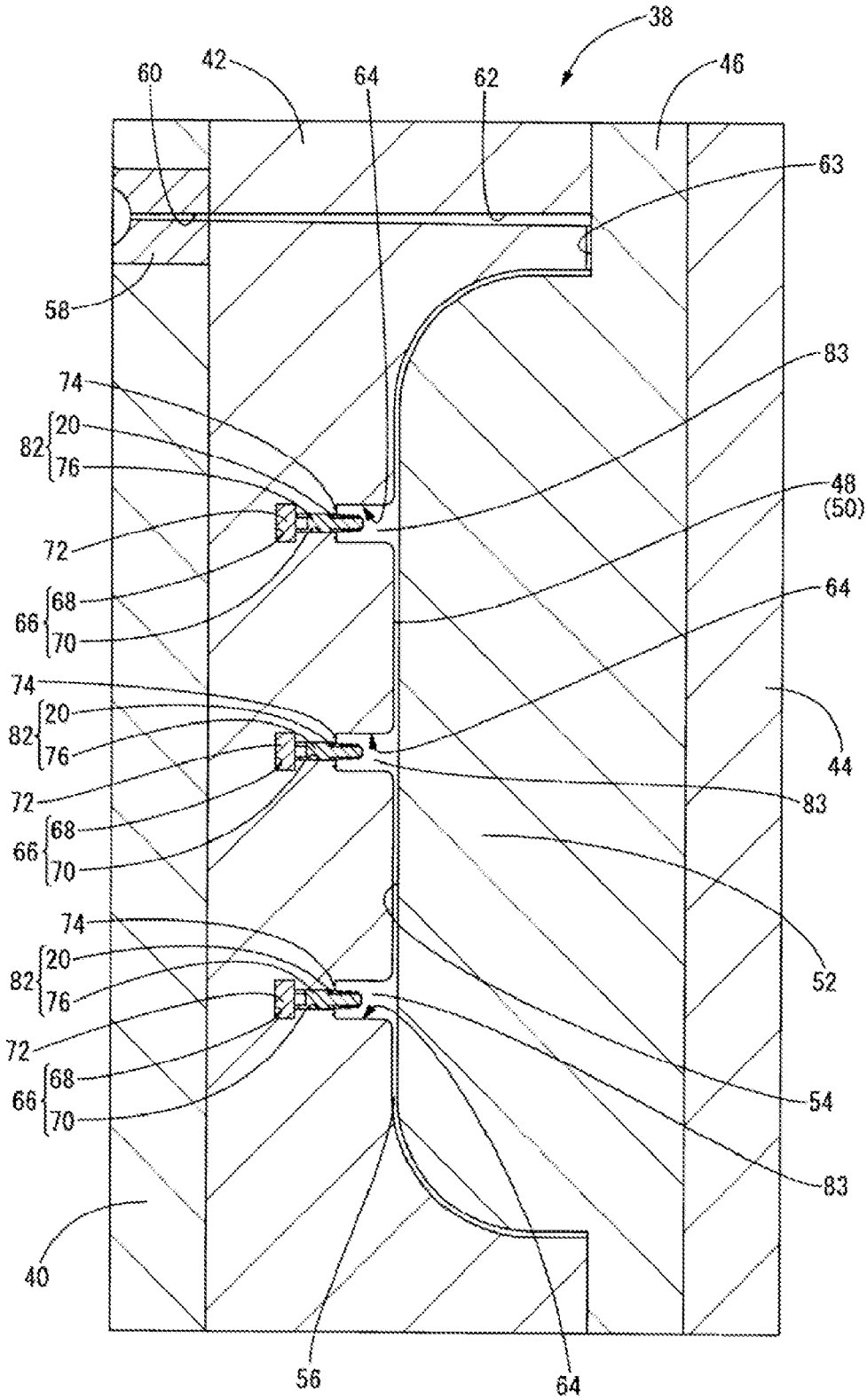
FIG. 10 is a diagram for explaining a step of the process of manufacturing the soundproofing cover illustrated in FIG. 1 by the method according to the present invention, and illustrates the state in which assemblies of nut members and dummy bolts are set in the mold illustrated in FIG. 7.

Next, as illustrated in FIG. 10, the three assemblies 82 are set to the first mold 38. First, while the first mold 38 is in the open state, the head portion 78 of the dummy bolt 76 in each assembly 82 is inserted into the dummy-bolt-receiving section 70 of each of the three receiving recesses 66 in the fixed mold piece 42. Accordingly, the end surface of the head portion 78 is attracted to the permanent magnet 72 placed in the magnet-receiving section 68 of each receiving recess 66. The nut member 20 in each assembly 82 is arranged in a manner such that the bottom end surface of the large-diameter portion 24, which is an end surface at the side opposite to the bearing surface 23 that comes into contact with the head portion 78 of the dummy bolt 76, is substantially flush with the bottom surface of the boss-portion-forming recess 64 (see FIG. 12).

Accordingly, only the large-diameter portion 24 of each nut member 20 is placed in the dummy-bolt-receiving section 70. The bearing surface 23 is at a position deeper than the bottom surface of the loop-shaped groove 74 in the dummy-bolt-receiving section 70 (see FIG. 12). The intermediate-diameter portions 28*a*, 28*b* and 28*c* and the small-diameter portions 26*a* and 26*b* of the nut member 20 are coaxially arranged in the boss-portion-forming recess 64. In the above-described arrangement, the opening of the threaded hole 22 at the side near the lower intermediate-diameter portion 28*c* is at an intermediate position of the boss-portion-forming recess 64 in the depth direction thereof. As is clear from the above, the depth of the boss-portion-forming recess 64 is greater than the height of a part of the boss-portion-forming recess 64 that receives the assembly 82 including the nut member 20 and the dummy bolt 76. Accordingly, a part of the boss-portion-forming recess 64 that is closer to the opening thereof and that is adjacent to the end face of the assembly 82, that is, the end face of the externally threaded portion 80 of the dummy bolt 76 that is screwed into the threaded hole 22 in the nut member 20, is formed as a blocking-portion-forming cavity section 83. The assembly 82 including the nut member 20 and the dummy bolt 76 is not disposed in the blocking-portion-forming cavity section 83.

Thus, the dummy bolt 76 (the assembly 82) is retained in the fixed mold piece 42 by being attracted to the permanent magnet 72 in a manner such that a part of each nut member 20 other than the large-diameter portion 24 including the bearing surface 23 projects into the first mold cavity 56 (the boss-portion-forming recess 64) from the fixed-mold-piece cavity surface 50.

Then, the molten resin material is ejected from a nozzle 84 of the injection molding machine (not shown) and guided into the first mold cavity 56 through the sprue 60, the sub-sprue 62 and the gate 63 in the fixed mold piece 42 so as to fill the first mold cavity 56. Then, the molten resin material is solidified.

Figure 11:
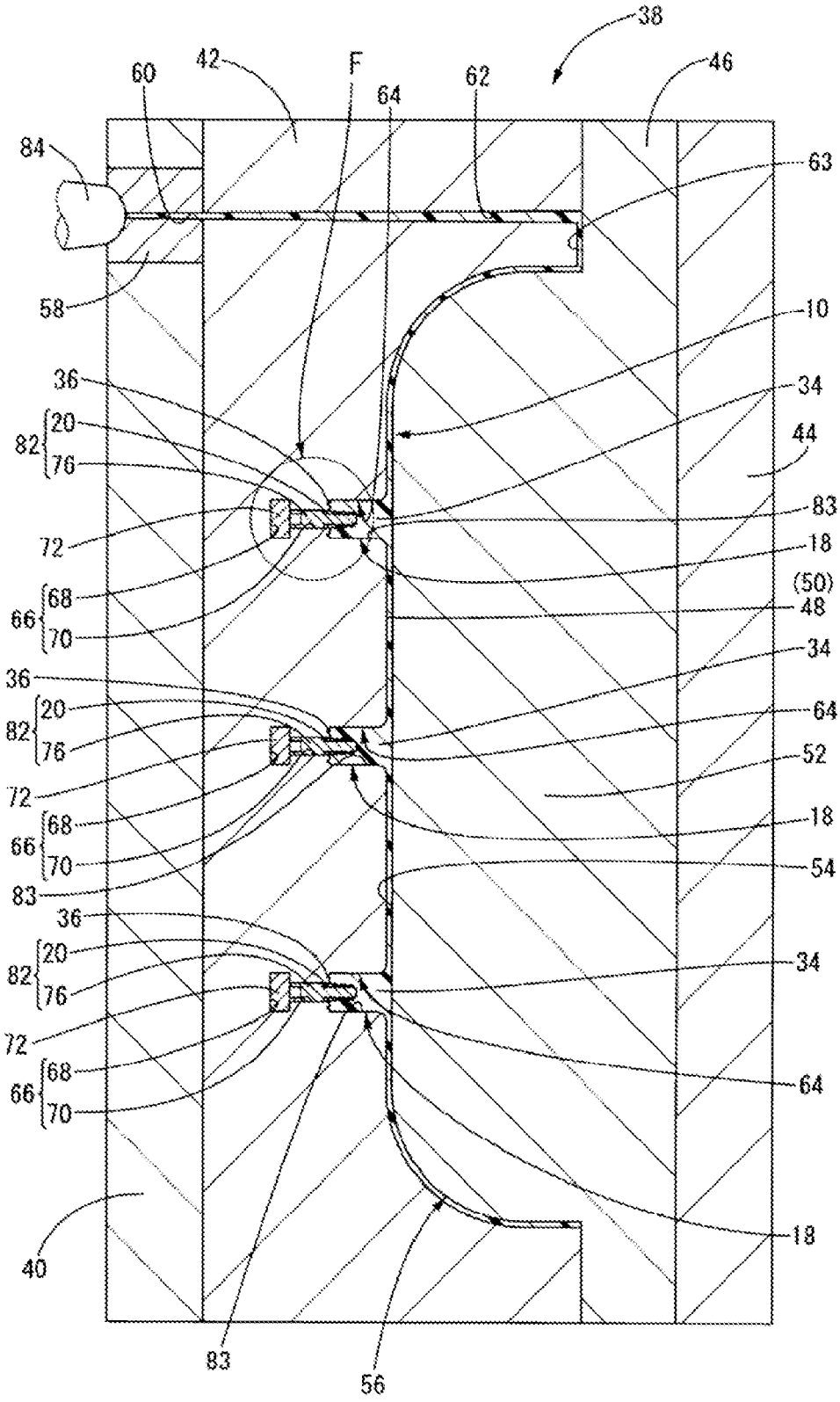
FIG. 11 is a diagram for explaining the step performed after the step illustrated in FIG. 10, and illustrates the state in which the cover body is formed in a mold cavity of the mold.

Accordingly, as illustrated in FIG. 11, the cover body 10 is formed in the first mold cavity 56 and the three boss portions 18 are formed integrally with the front surface of the cover body 10 so as to project therefrom. At the same time, a single nut member 20, to which the dummy bolt 76 is fastened, is coaxially embedded in each of the boss portions 18 formed on the front surface of the cover body 10.

Figure 12:
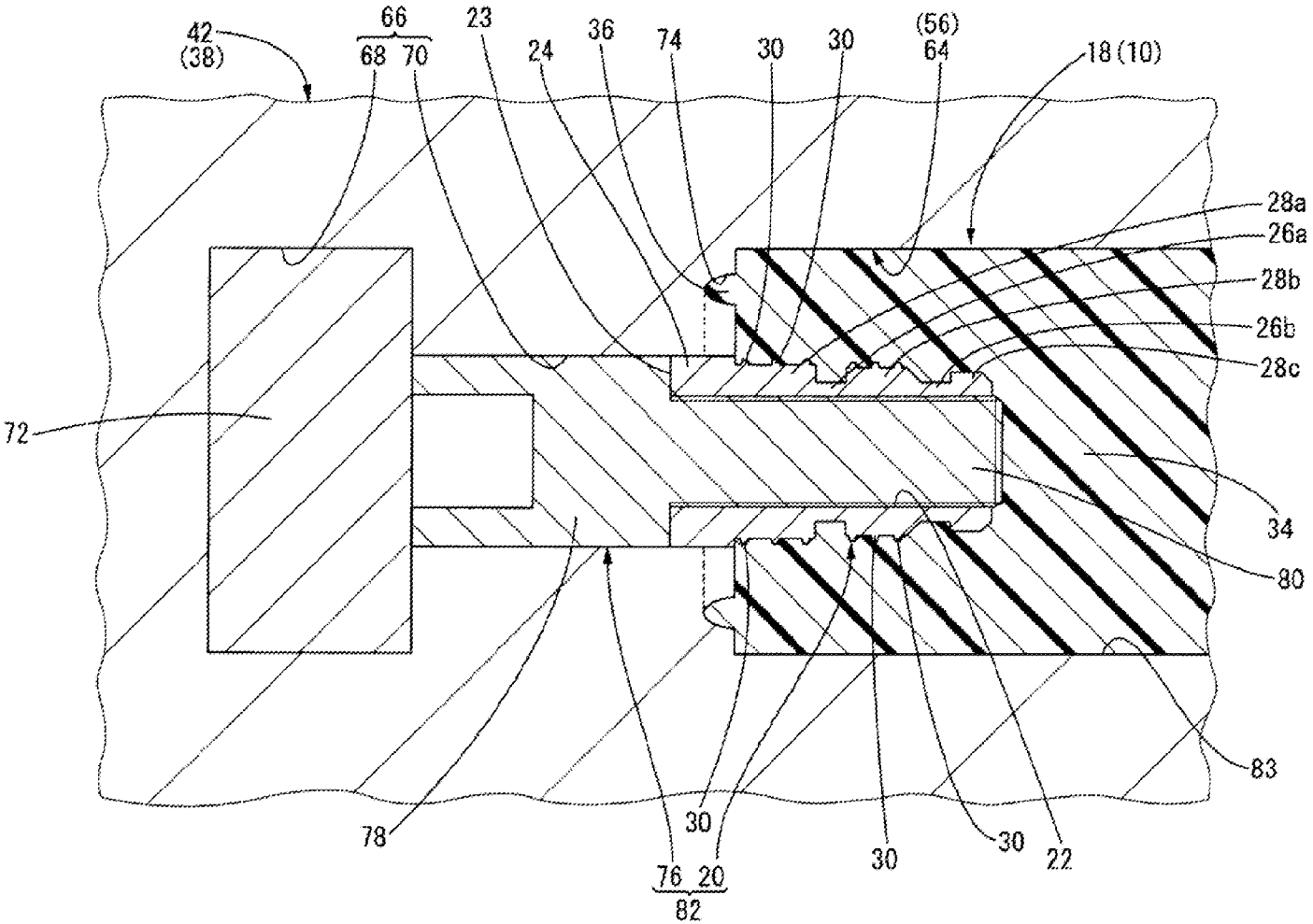
FIG. 12 is an enlarged view of part F in FIG. 11.

As illustrated in FIG. 12, only the large-diameter portion 24 of the nut member 20 embedded in each boss portion 18 projects from the projecting end surface of the boss portion 18. The portions other than the large-diameter portion 24 (the intermediate-diameter portions 28*a*, 28*b* and 28*c* and the small-diameter portions 26*a* and 26*b*) are embedded in the boss portion 18. The opening of the threaded hole 22 at the side of the large-diameter portion 24 opens in the front surface of the cover body 10. The opening of the threaded hole 22 at the side of the lower intermediate-diameter portion 28*c* is blocked by the base portion of the boss portion 18. Accordingly, the bearing surface 23, which is the end surface of the large-diameter portion 24, is exposed at the front surface of the cover body 10 at a position higher than the end surface of each boss portion 18 (see FIG. 13). The blocking portion 34, which blocks the opening of the threaded hole 22 in each nut member 20 at the side of the lower intermediate-diameter portion 28*c*, is formed integrally with the back surface of the cover body 10. The blocking portion 34 is the base portion of each boss portion 18 that has been formed in the blocking-portion-forming cavity section 83.

With the above-described procedure, the cover body 10 including the three boss portions 18 that are integrated therewith is manufactured. At the same time, the annular loop-shaped projection 36 is formed in the loop-shaped groove 74 in each boss-portion-forming recess 64. The annular loop-shaped projection 36 is formed integrally with the end surface of each boss portion 18 in the outer peripheral area thereof. The loop-shaped projection 36 is formed so as to surround the bearing surface 23 of the nut member 20 embedded in each boss portion 18. The height of the end portion of the loop-shaped projection 36 is smaller than the height of the bearing surface 23.

The first mold 38 is opened after the cover body 10 is formed. The mold opening force applied to open the first mold 38 is set to be greater than an attraction force with which the dummy bolts 76 are attracted to the permanent magnets 72. The cover body 10 is in tight contact with the movable-mold-piece cavity surface 54 of the movable mold piece 46 with an adhesion force greater than the attraction force. Therefore, although not illustrated, with a simple mold opening operation that does not involve any additional operations, the first mold 38 can be opened in a state such that the dummy bolts 76 are released from the permanent magnets 72 but the cover body 10 is continuously in tight contact with the movable-mold-piece cavity surface 54.

Figure 13:
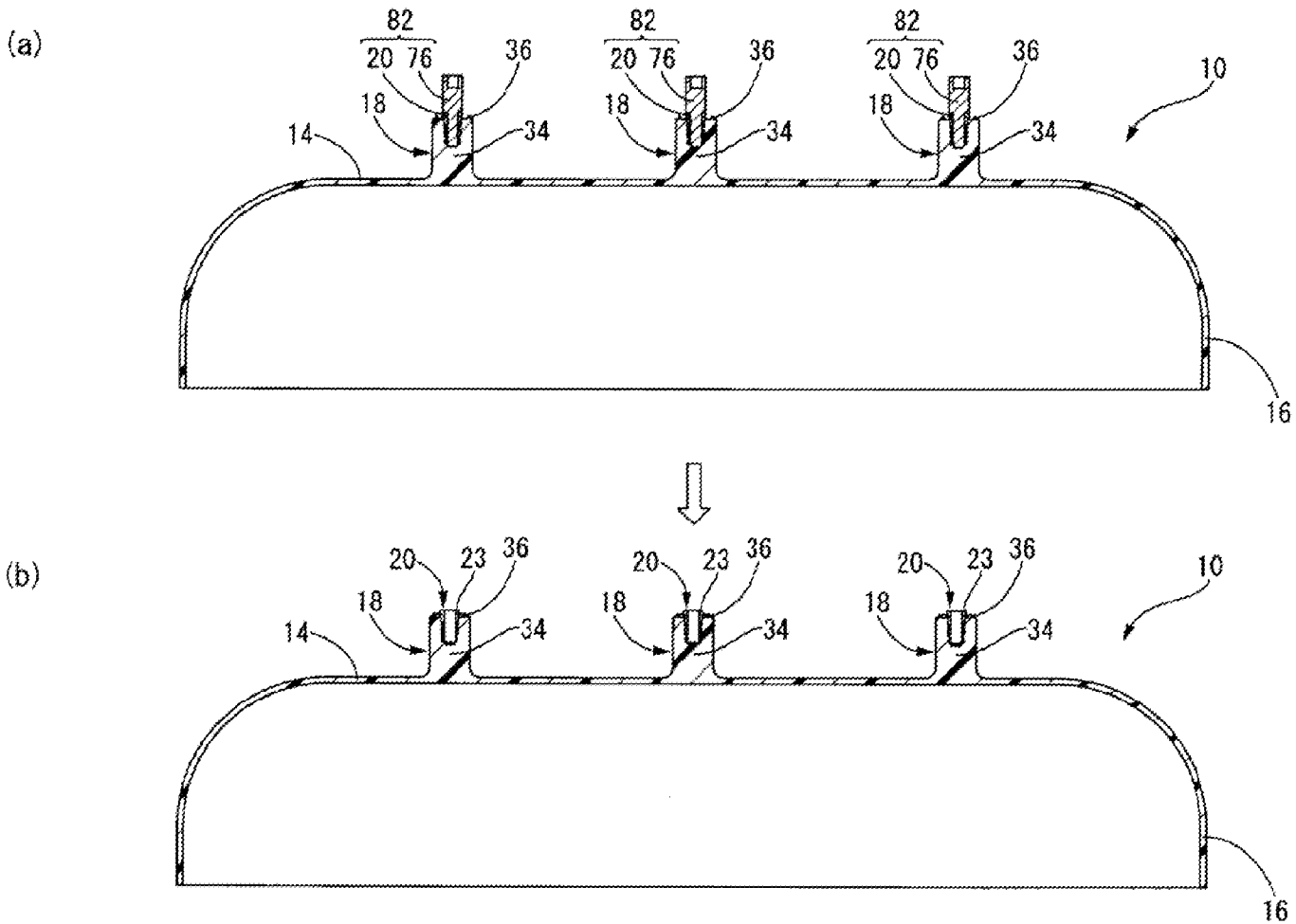
FIG. 13 is a diagram for explaining the step performed after the step illustrated in FIG. 11, where part (a) illustrates the cover body taken out from the mold and part (b) illustrates the state in which the dummy bolts are removed from the nut members embedded in the cover body.

Then, as illustrated in part (a) of FIG. 13, the cover body 10 is removed from the first mold 38 while the dummy bolts 76 are continuously fastened to the nut members 20 embedded in the boss portions 18. As described above, the cover body 10 is in tight contact with the movable-mold-piece cavity surface 54 of the movable mold piece 46. However, the cover body 10 can be easily released from the movable mold piece 46 by using, for example, an ejector mechanism including an ejector pin.

Then, as illustrated in part (b) of FIG. 13, the dummy bolts 76 are removed from the nut members 20 in the cover body 10. The dummy bolts 76 are components that are independent of the first mold 38. Therefore, unlike the case in which the dummy bolts 76 are formed integrally with the fixed mold piece 42, the dummy bolts 76 can be easily removed from the nut members 20 simply by rotating each dummy bolt 76, and a large-scale process of, for example, rotating the entire body of the fixed mold piece 42 is not necessary.

Figure 14:
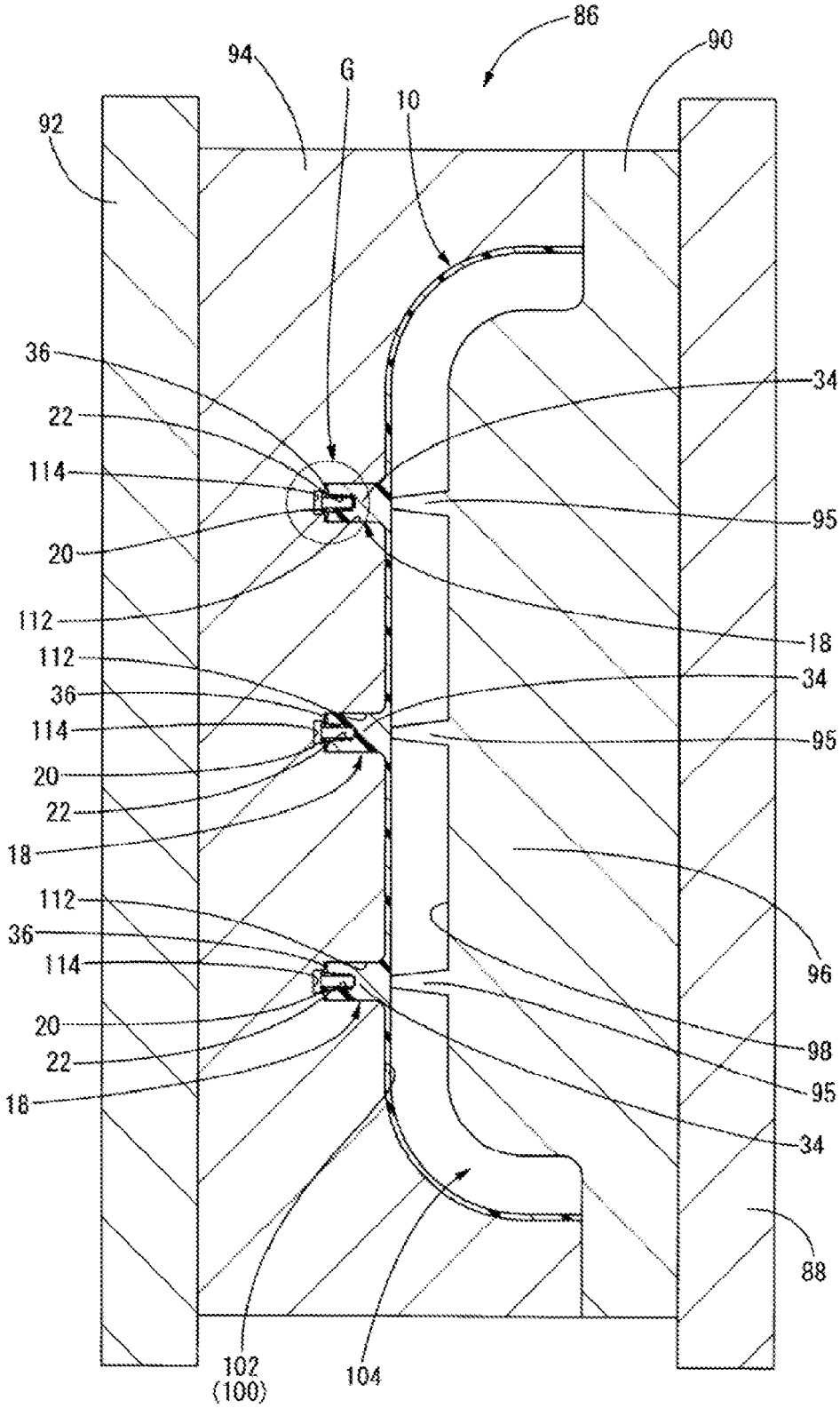
FIG. 14 is a diagram for explaining the step performed after the step illustrated in FIG. 13, and illustrates the state in which the cover body is set in a mold used to form a sound absorbing layer.

Next, as illustrated in FIG. 14, the cover body 10 is set in a second mold 86 used to form the sound absorbing layer 12. The second mold 86 includes a fixed mold piece 94 and a movable mold piece 90. The fixed mold piece 94 is attached to a stationary plate 92, which is stationary. The movable mold piece 90 is attached to a movable plate 88, which is movable towards and away from the stationary plate 92, and is opposed to the fixed mold piece 94.

A cavity-forming projection 96 is formed integrally with a surface of the movable mold piece 90 that faces the fixed mold piece 94 in the second mold 86. Pressing projections 95 are formed integrally with the outer surface of the cavity-forming projection 96 at positions corresponding to the boss portions 18 of the cover body 10. The pressing projections 95 press the cover body 10 so as to prevent the cover body 10 from moving after the cover body 10 is set in the second mold 86, as described below. The entire area of the outer surface of the cavity-forming projection 96 serves as a movable-mold-piece cavity surface 98 that has a shape corresponding to the shape of the back surface of the sound absorbing layer 12. A cavity-forming recess 100 into which the cavity-forming projection 96 of the movable mold piece 90 can be inserted is formed in a surface of the fixed mold piece 94 that faces the movable mold piece 90. The entire area of the inner surface of the cavity-forming recess 100 serves as a fixed-mold-piece cavity surface 102 that has a shape corresponding to the shape of the front surface of the cover body 10.

When the fixed mold piece 94 and the movable mold piece 90 are put together so that the cavity-forming projection 96 of the movable mold piece 90 is inserted into the cavity-forming recess 100 in the fixed mold piece 94, a second mold cavity 104 is formed between the movable-mold-piece cavity surface 98 and the fixed-mold-piece cavity surface 102. The second mold cavity 104 has a shape corresponding to the external shape of the soundproofing cover to be manufactured.

Figure 15:
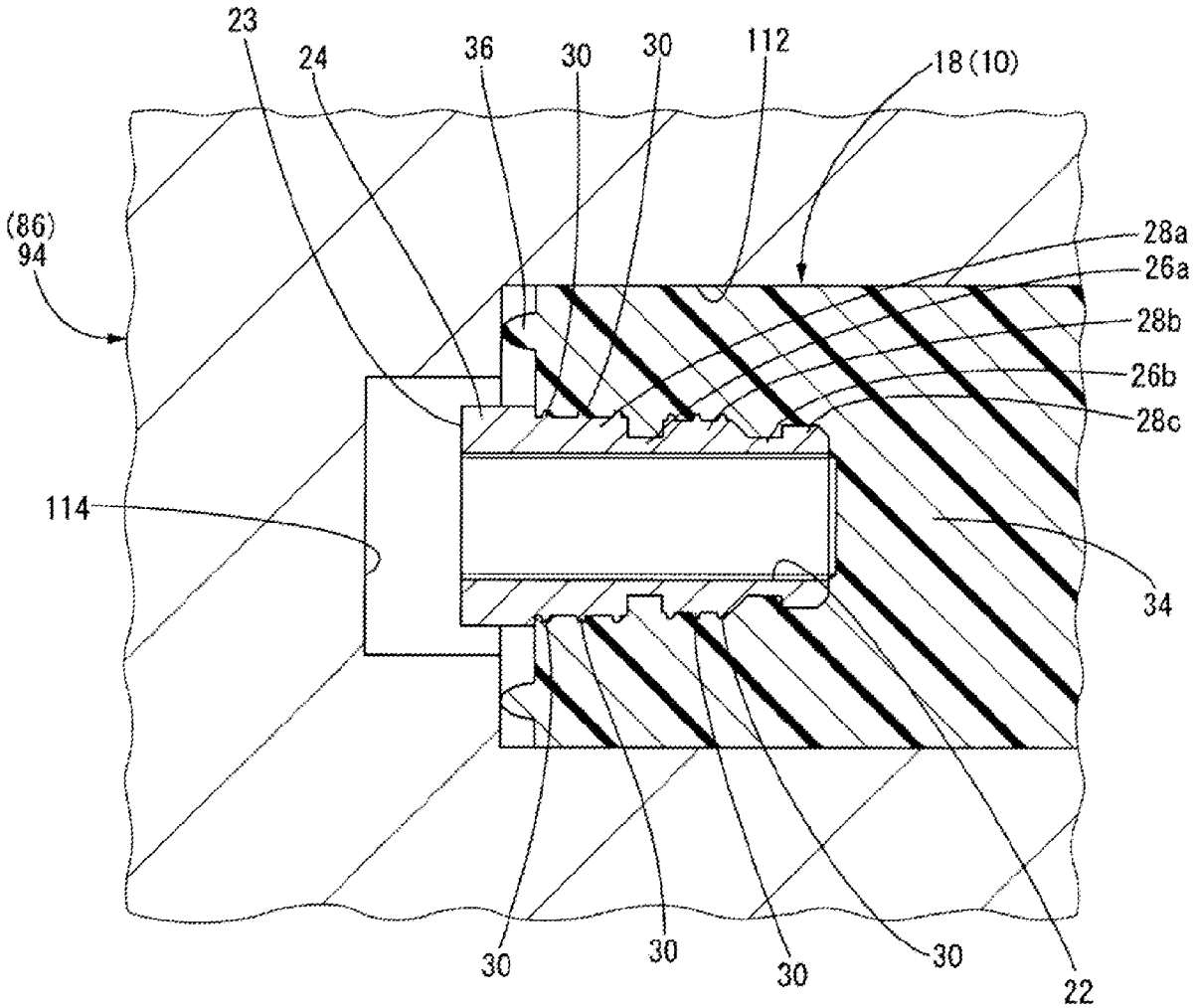
FIG. 15 is an enlarged view of part G in FIG. 14.

Three boss-portion-receiving recesses 112 are formed along a line in the fixed-mold-piece cavity surface 102 of the fixed mold piece 94 in a substantially central area thereof. The internal shape of the boss-portion-receiving recesses 112 corresponds to the shape of the three boss portions 18 that are formed integrally with the cover body 10. As illustrated in FIG. 15, each boss-portion-receiving recess 112 has a central recess 114 having a circular shape that opens in the bottom surface of the boss-portion-receiving recess 112 at a central area thereof. The diameter of the central recess 114 is larger than the outer diameter of the large-diameter portion 24 of the nut member 20 embedded in each boss portion 18, and is smaller than the inner diameter of the loop-shaped projection 36 formed on the end surface of each boss portion 18 in the outer peripheral area thereof. The depth of the central recess 114 is greater than the height of the large-diameter portion 24 of the nut member 20.

As illustrated in FIGS. 14 and 15, the cover body 10 is set to the fixed mold piece 94 so that the cover body 10 can be placed in the second mold cavity 104 formed in the second mold 86 having the above-described structure when the second mold 86 is in the closed state. It is to be noted that, although the cover body 10 is set to the fixed mold piece 94 while the second mold 86 is in the open state in practice, FIGS. 14 to 15 illustrate the state in which the cover body 10 is set to the fixed mold piece 94 while the second mold 86 is in the closed state to clarify the position of the cover body 10 in the second mold cavity 104.

When the cover body 10 is set to the fixed mold piece 94, the front surface of the cover body 10 is in close contact with the fixed-mold-piece cavity surface 102 and the back surface of the cover body 10 is exposed in the second mold cavity 104. In addition, the three boss portions 18 formed integrally with the front surface of the cover body 10 are placed in the three boss-portion-receiving recesses 112 formed in the fixed-mold-piece cavity surface 102. In this state, the end portion of the loop-shaped projection 36 of each boss portion 18 is brought into contact with the bottom surface of each boss-portion-receiving recess 112 in the outer peripheral area thereof. In addition, the end portion of the large-diameter portion 24 of the nut member 20 that projects from the end surface of each boss portion 18 is arranged so as to project into the central recess 114.

Next, in the open state in which the movable mold piece 90 is separated from the fixed mold piece 94, a liquid urethane resin composition 116 is injected into the cavity-forming recess 100 in the fixed mold piece 94 from an injection nozzle (not shown) of a urethane-resin-composition injector.

Figure 16:
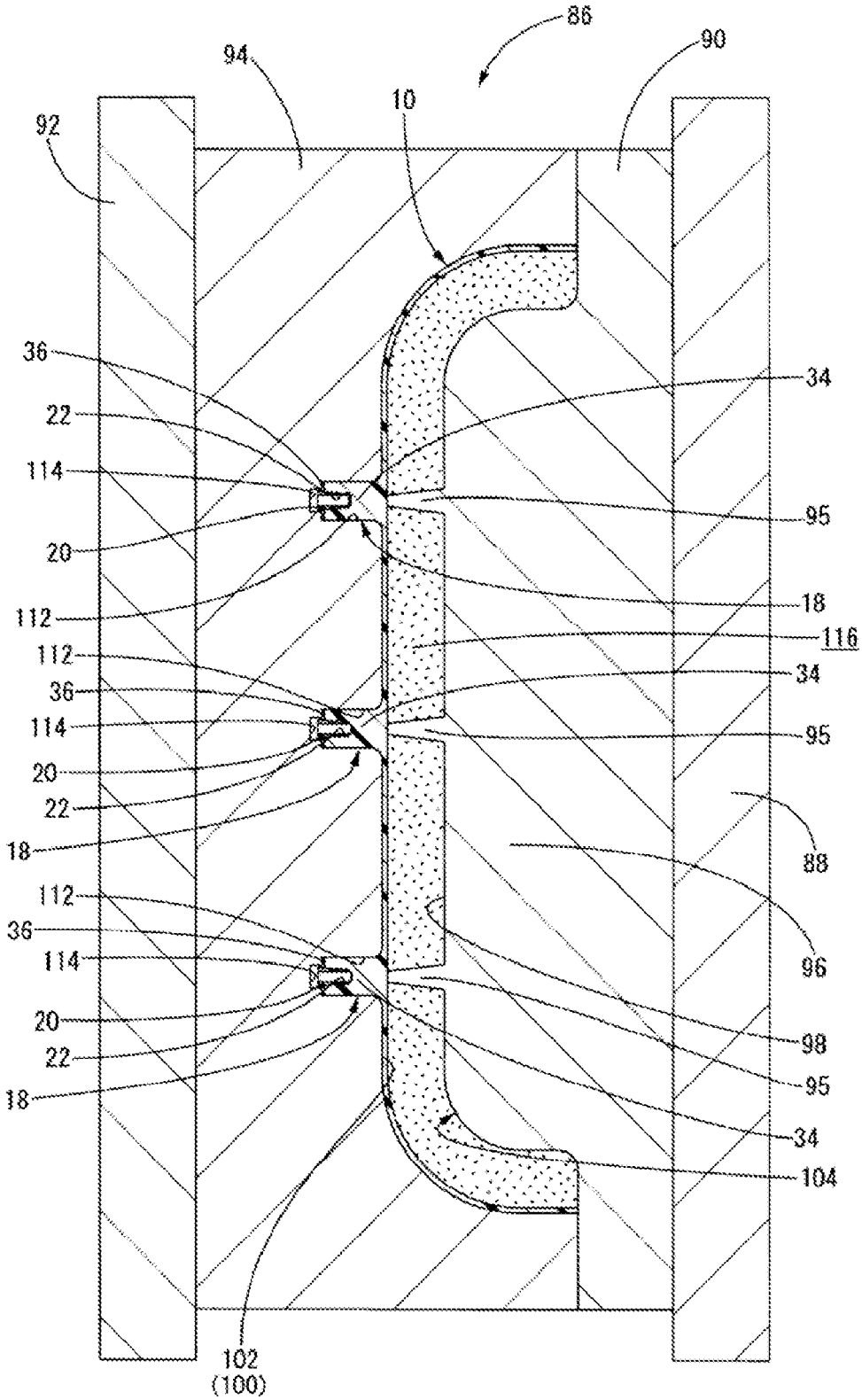
FIG. 16 is a diagram for explaining the step performed after the step illustrated in FIG. 14, and illustrates the state in which the mold in which the cover body is placed is filled with a urethane resin composition.

Then, as illustrated in FIG. 16, the movable mold piece 90 and the fixed mold piece 94 are put together to form the second mold cavity 104. Then, the liquid urethane resin composition 116 is foamed at the back side of the cover body 10 in the second mold cavity 104. As a result, the sound absorbing layer 12 is formed integrally with the back surface of the cover body 10 by the foaming process, and an integrally molded article including the cover body 10 and the sound absorbing layer 12 is obtained.

When the movable mold piece 90 and the fixed mold piece 94 are put together, the front surface of the cover body 10 is pressed against the fixed-mold-piece cavity surface 102 of the fixed mold piece 94 by the pressing projections 95 on the movable mold piece 90. In addition, the end portion of the loop-shaped projection 36 formed on the end surface of each boss portion 18 is pressed against the bottom surface of the boss-portion-receiving recess 112 in the outer peripheral area thereof.

When the liquid urethane resin composition 116 is injected or foamed, there is a possibility that the urethane resin composition 116 in the second mold cavity 104 will flow onto the front side of the cover body 10 from, for example, an opening of the injector (not shown). Even when the urethane resin composition 116 flows onto the front side of the cover body 10, since the front surface of the cover body 10 is pressed against the fixed-mold-piece cavity surface 102, the loop-shaped projection 36 advantageously serves as a sealing member that seals the gap between the end surface of each boss portion 18 and the bottom surface of the boss-portion-receiving recesses 112. Therefore, the urethane resin composition 116 is effectively prevented from entering the threaded hole 22 in the nut member 20 through the opening of the threaded hole 22 that opens in the end surface of the boss portion 18. The opening of the threaded hole 22 in the nut member 20 at the side closer to the back surface of the cover body 10 is blocked by the blocking portion 34, which is formed of the base portion of the boss portion 18, and does not allow the urethane resin composition 116 to enter the threaded hole 22.

Then, the integrally molded article including the cover body 10 and the sound absorbing layer 12 is removed from the second mold 86. As a result, the soundproofing cover having the structure illustrated in FIGS. 1 to 3 is obtained.

Thus, in the soundproofing cover according to the present embodiment, a single inexpensive nut member 20 having a threaded hole that opens at both sides of the nut member 20 is embedded in each of the three boss portions 18 that are formed integrally with the front surface of the cover body 10. When the soundproofing cover is attached to the cylinder head cover and placed in the engine room, components around the soundproofing cover can be attached to the soundproofing cover with a screw-fastening structure by fastening a screw, a bolt, etc., to the nut member 20 in each boss portion 18.

Therefore, although a soundproofing cover according to the related art includes a cover body that has through holes for allowing boss portions that project from a cylinder head cover to project therethrough, such through holes can be eliminated in the soundproofing cover according to the present embodiment. As a result, noise leakage from the engine through the through holes can be effectively prevented, and sufficiently high soundproofing performance can be achieved.

In the soundproofing cover according to the present embodiment, the loop-shaped projection 36 is formed integrally with the end surface of each boss portion 18, in which the nut member 20 is embedded, so as to extend in the circumferential direction of the bearing surface 23 of the nut member 20. In addition, the opening of the threaded hole 22 in the nut member 20 at the side closer to the back surface of the cover body 10 is blocked by the blocking portion 34 of each boss portion 18. Therefore, when the sound absorbing layer 12 made of the urethane foam is formed integrally with the back surface of the cover body 10 in the second mold cavity 104, the urethane resin composition 116 that flows in the second mold cavity 104 can be prevented from entering the threaded hole 22 in the nut member 20, as described above.

If the urethane resin composition is solidified after flowing into the threaded hole 22 in the nut member 20, it will be difficult to fasten a screw, a bolt, or the like to the nut member 20, owing to the solidified urethane foam. However, such a situation can be prevented according to the present embodiment. As a result, each boss portion 18 allows another member to be reliably attached thereto with a screw-fastening structure.

Although the detailed structure according to the present invention has been described above, the above-described structure is merely an example. The present invention is not limited in any way to the above description.

Figure 17:
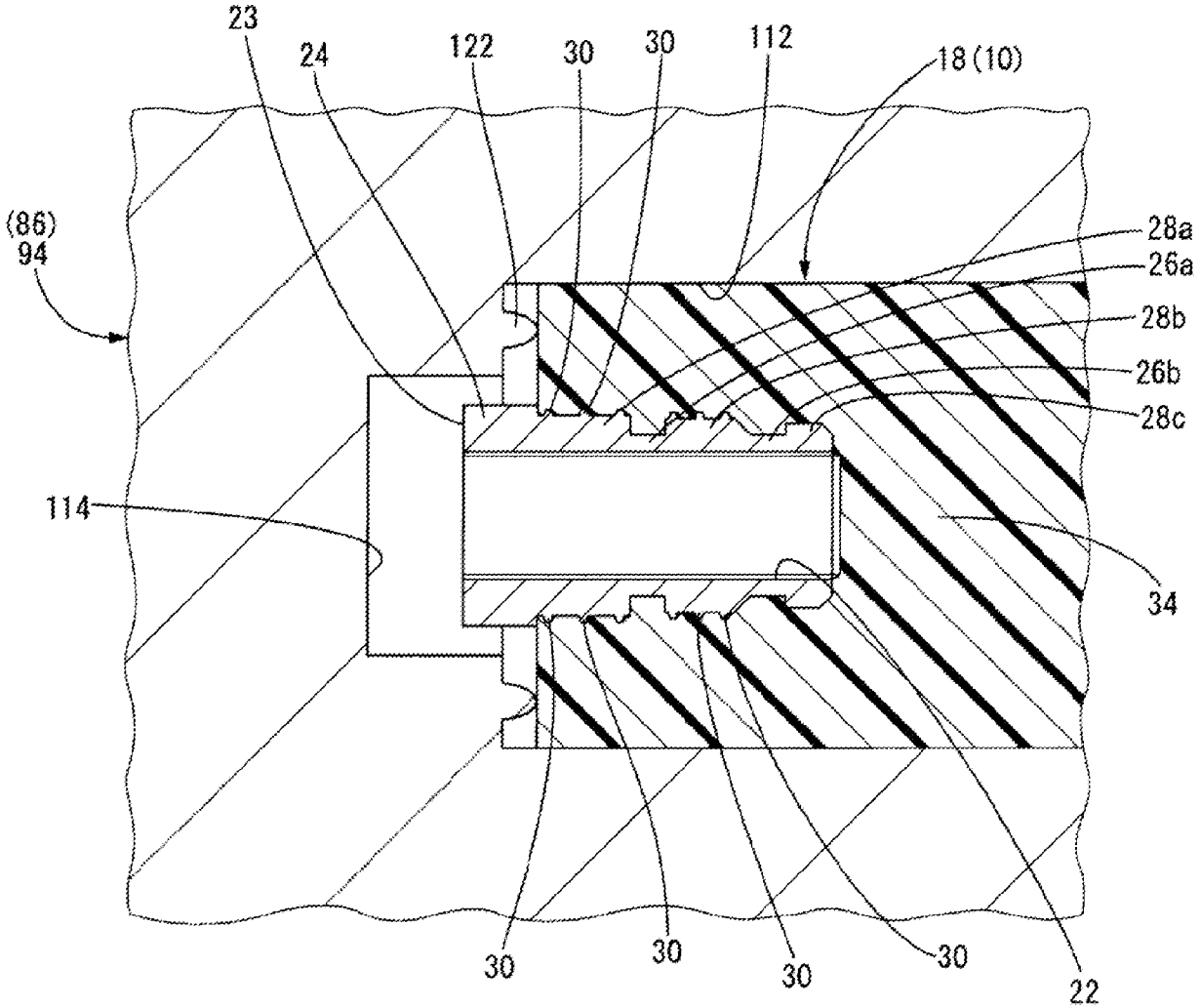
FIG. 17 is a diagram corresponding to FIG. 15, and illustrates a step of the process of manufacturing a soundproofing cover having a structure different from that illustrated in FIG. 1 by the method according to the present invention.

In the above-described embodiment, the loop-shaped projection 36 is formed integrally with the end surface of each boss portion 18 of the cover body 10 so as to extend in the circumferential direction of the bearing surface 23 of the nut member 20. However, as illustrated in FIG. 17, for example, a sealing projection 122 may be formed on the bottom surface of the boss-portion-receiving recess 112, which receives each boss portion 18 of the cover body 10, so as to extend in the circumferential direction of the bearing surface 23 of the nut member 20 and surround the bearing surface 23. In such a case, the loop-shaped projection (36) on the end surface of the boss portion 18 may be omitted. In the soundproofing cover according to the present embodiment and the second mold 86 used to form the soundproofing cover, components and parts similar to those of the soundproofing cover according to the previous embodiment and the second mold used to form the soundproofing cover are denoted by the same reference numerals as those used in FIG. 15, and explanations thereof are thus omitted.

When the loop-shaped projection 36 is provided, the overall shape of the loop-shaped projection 36 is not particularly limited as long as the loop-shaped projection 36 forms a closed loop that extends in the circumferential direction of the bearing surface 23 of the nut member 20. The cross sectional shape of the loop-shaped projection 36 is also not limited to the above-described shape, and may be, for example, various types of polygonal shapes or shapes having curved ridge lines.

The nut members 20 may, of course, be embedded in the cover body 10 that does not have the boss portions 18. In such a case, the thickness of the cover body 10 is set to be greater than the height of the portion of each nut member 20 that is embedded in the cover body 10. In addition, a portion of the cover body 10 that is closer to the back surface thereof than each nut member 20 embedded therein serves as the blocking portion 34.

It is not necessary that the end portion of the nut member 20 at the side of the bearing surface 23 (the large-diameter portion 24 in the above-described embodiment) project from the front surface of the cover body 10 as long as the bearing surface 23 is exposed at the front surface of the cover body 10 when the nut member 20 is embedded in the cover body 10. For example, each nut member 20 may be embedded in the cover body 10 in a manner such that the bearing surface 23 and the front surface of the cover body 10 are flush with each other. In such a case, when the cover body 10 is formed, the entire body of the nut member 20 is placed in the boss-portion-forming recess 64 in a manner such that the bearing surface 23 of the nut member 20 and the bottom surface of the boss-portion-forming recess 64 in the first mold 38 are flush with each other.

In addition, in the present invention, it is not essential that the biting projections 30 be formed on the outer peripheral surface of each nut member 20. However, when the biting projections 30 are formed, the external shapes and cross sectional shapes of the biting projections 30 may differ from the above-described shapes. For example, with regards to the external shape of the biting projections 30, instead of the projections that extend in the circumferential direction of the nut member, projections that are independent of each other may be used as appropriate. In addition, the cross sectional shape of the biting projections may be, for example, various types of polygonal shapes or shapes having curved ridge lines.

The present invention may be advantageously applied not only to a soundproofing cover that covers a cylinder head cover of a vehicle engine and a method of manufacturing the soundproofing cover, but also to other types of soundproofing covers in which a sound absorbing layer made of a urethane foam is formed integrally with the back surface of a cover body formed of a hard resin-molded article and methods for manufacturing the soundproofing covers.

Although details are omitted, persons skilled in the art may carry out embodiments of the present invention with various alterations, modifications or improvements. It goes without saying that such embodiments are included within the scope of the present invention unless they depart from the spirit of the present invention.

What is claimed is:

1. A soundproofing cover comprising:

a cover body formed of a hard resin-molded article;

a sound absorbing layer fixed to a back surface of the cover body and made of a urethane foam that is formed integrally with the back surface of the cover body by foaming a urethane resin composition in a mold in which the cover body is placed; and a nut member having a threaded hole that opens at both sides of the nut member in an axial direction, the nut member being embedded in the cover body in a manner such that a bearing surface at a first end in the axial direction is exposed at a front surface of the cover body and an opening of the threaded hole at the first end in the axial direction opens in the front surface of the cover body, an opening of the threaded hole in the nut member at a second end in the axial direction being blocked by a blocking portion that is formed integrally with the cover body.

2. The soundproofing cover according to claim 1, wherein a portion of the nut member including the bearing surface at the first end in the axial direction projects from the front surface of the cover body.

3. The soundproofing cover according to claim 1, wherein a boss portion having a height greater than a height of a portion of the nut member that is embedded in the cover body is formed integrally with the front surface of the cover body so as to project therefrom, wherein the nut member is embedded in the boss portion in a manner such that the bearing surface is exposed at a projecting end surface of the boss portion, and wherein the blocking portion is formed of a base end portion of the boss portion.

4. The soundproofing cover according to claim 1, wherein a loop-shaped projection is formed integrally with the front surface of the cover body in an area around the bearing surface of the nut member so as to extend in a circumferential direction of the bearing surface of the nut member.

5. The soundproofing cover according to claim 1, wherein the nut member is made of a material that is harder than the cover body and that expands radially while contracting in the axial direction in response to an axial force applied by a fastening member when the fastening member is fastened to the nut member, and wherein the nut member has a biting projection on an outer peripheral surface thereof, the biting projection biting into an inner peripheral surface of a hole in the cover body in which the nut member is embedded when the nut member expands radially in response to the axial force applied by the fastening member.

6. The soundproofing cover according to claim 5, wherein the biting projection includes a first helical biting projection and a second helical biting projection, the first helical biting projection being provided on the outer peripheral surface of the nut member in an area near the first end in the axial direction and extending helically along a circumferential direction of the nut member, and the second helical biting projection being provided on the outer peripheral surface of the nut member in an area near the second end in the axial direction and extending helically in a direction opposite to a direction in which the first helical biting projection along the circumferential direction of the nut member.

7. A method of manufacturing the soundproofing cover according to claim 1, comprising:

preparing a first mold having a first mold cavity having a shape corresponding to a shape of the cover body, a dummy bolt that is capable of being fastened to the nut member and that is independent of the first mold, and attracting means that attracts the dummy bolt so that the dummy bolt is retained in the first mold;

forming the cover body in the first mold cavity in a manner such that the nut member is embedded in the cover body and the blocking portion is formed integrally with the cover body, the forming of the cover body including fastening the dummy bolt to the nut member, causing the attracting means to attract the dummy bolt so that the dummy bolt is retained in the first mold in a manner such that the entire body of the nut member or a portion of the nut member other than a portion including the bearing surface at the first end in the axial direction projects into the first mold cavity from a first cavity surface that defines the first mold cavity, injecting a molten resin into the first mold cavity to fill the first mold cavity, and solidifying the molten resin;

removing the dummy bolt from the nut member embedded in the cover body after removing the cover body and the dummy bolt together from the first mold by opening the first mold, in which the cover body is formed in the first mold cavity, while releasing the dummy bolt from the state in which the dummy bolt is retained in the first mold by being attracted to the attracting means; and forming the sound absorbing layer made of the urethane foam integrally with the back surface of the cover body by using a second mold having a second mold cavity having a shape corresponding to a shape of the sound absorbing layer, the forming of the sound absorbing layer including placing the cover body in the second mold cavity, injecting the urethane resin composition into a space at the back side of the cover body in the second mold cavity, and foaming the urethane resin composition.

8. The method according to claim 7, wherein the dummy bolt is fastened to the nut member by being screwed into the nut member in a manner such that an end face of the nut member at a side opposite to the bearing surface at the first end in the axial direction and an end face of a leg portion of the bolt are flush with each other, and wherein, in the state in which the dummy bolt fastened to the nut member is retained in the first mold, a blocking-portion-forming cavity section for forming the blocking portion is provided in the first mold cavity in a space adjacent to the end face of the leg portion of the dummy bolt.

9. The method according to claim 7, wherein a recess is formed in the first cavity surface in an area in which the entire body of the nut member or the portion of the nut member other than the portion including the bearing surface at the first end in the axial direction projects into the first mold cavity, the recess having a depth that is greater than a projection height to which the nut member projects into the first mold cavity, and wherein the entire body of the nut member to which the dummy bolt is fastened or the portion of the nut member other than the portion at the first end in the axial direction projects into the recess from a bottom surface of the recess, and a blocking-portion-forming cavity section for forming the blocking portion is provided in the recess at a position near an opening of the recess.

10. The method according to claim 7, wherein, in the state in which the nut member is placed in the first mold cavity, a loop-shaped groove is formed in the first cavity surface in an area around a projecting portion of the nut member that projects into the first mold cavity, the loop-shaped groove extending in a circumferential direction of the projecting portion of the nut member, wherein, when the molten resin is injected into the first mold cavity and solidified, the cover body is formed in the first mold cavity in a manner such that the nut member is embedded in the cover body and a loop-shaped projection is formed integrally with the front surface of the cover body in an area around the bearing surface of the nut member so as to extend in a circumferential direction of the bearing surface of the nut member, and wherein the urethane resin composition is foamed in the second mold cavity after the cover body is placed in the second mold cavity in a manner such that an end portion of the loop-shaped projection is brought into contact with a second cavity surface of the second mold.

* * * * *